United States Patent [19]

Walsh, Jr.

[11] 4,314,670

[45] Feb. 9, 1982

[54] VARIABLE GAS ATOMIZATION

[76] Inventor: William A. Walsh, Jr., 250 N. Bay St., Manchester, N.H. 03104

[21] Appl. No.: 178,503

[22] Filed: Aug. 15, 1980

[51] Int. Cl.[3] ..... B05B 7/06; B05B 7/08

[52] U.S. Cl. ..... 239/11; 239/417; 239/422; 239/424; 239/452; 239/458; 239/468

[58] Field of Search ..... 239/8, 11, 413, 416.5, 239/417, 419.3, 420, 422, 424, 428, 433, 434.5, 455, 457, 458, 568, 597, 452

[56] References Cited

U.S. PATENT DOCUMENTS 2,259,011 10/1941 Taylor ..... 239/411 X 3,912,164 10/1975 Lefebvre et al. ..... 239/88 X

FOREIGN PATENT DOCUMENTS 2705706 8/1978 Fed. Rep. of Germany ..... 239/428

*Primary Examiner*—Robert B. Reeves

*Assistant Examiner*—Paul A. Sobel

*Attorney, Agent, or Firm*—Thomas N. Tarrant

[57] ABSTRACT

A method of atomization control and related gas atomizing nozzles are described which enable variation of the degree of atomization, the liquid and gas flow rates and the atmospheric spray dilution. Varying the thickness of flowing liquid and adjacent atomizing gas sheets varies spray droplet size and atmospheric spray dilution. Transverse sheet size is varied to change nozzle capacity. Annular and linear sheet forming nozzles are described. Nozzles are also described with flexible divider walls whereby thickness of the flowing sheets may be varied by altering relative flow pressures.

13 Claims, 22 Drawing Figures

VARIABLE GAS ATOMIZATION

BACKGROUND OF THE INVENTION

1. Field of the Invention

This invention relates to gas atomizing nozzles, and a method and apparatus for varying and controlling the degree of atomization, the nozzle capacity and the spray dilution, over wide ranges.

2. Description of the Prior Art

Atomization is considered to be the process of breaking up a liquid and dispersing it into a surrounding atmosphere in the form of fog, mist, fine spray or coarse drops. Gas atomization involves the break-up of a liquid stream by contact with a high velocity gas stream, typically compressed air or steam. Industrially, gas atomizing nozzles are generally employed where relatively fine sprays are required. Typically, the degree of atomization, with gas atomizing nozzles, is such that the characteristic droplet size of the resulting spray (frequently expressed in terms of the mass median diameter, or MMD) is in the range of 10 to 100 microns, and the individual nozzle capacities are usually below 1 gpm. (4 lit./min.).

Many techniques have been devised in an effort to significantly increase the liquid capacity, and to economically apply gas atomizing nozzles to processes in which MMD's greater than 100 microns are permissible. A brief outline of some of these follows: Multiple gas jets, set at an angle to the liquid jet, have been used to produce jet impact. A spiral insert, or tangential liquid entry, placed upstream of a liquid orifice, has been used to produce a diverging liquid sheet. Opposing, tangential velocity components have been added to the gas stream. The liquid has been fed through a converging annular nozzle so that it flows with a radially inward component, as a sheet, into a centrally located gas nozzle. Mixing chambers, usually terminating in a nozzle, have been added downstream of the liquid and primary gas contact zone. Convergent-divergent gas nozzles have been used in an effort to aid atomization by supersonic flow or shock wave effects. The general problem with prior efforts to increase gas atomizer capacity is that the spray droplet size increases as the flow rate and nozzle size are increased, and the gas consumption becomes excessive. Because of the difficulties encountered in scaling up gas atomizers, pressure nozzles, spining disk atomizers, or a multiplicity of gas atomizers, are generally employed where high flow rates are required.

One exception has been the field of snowmaking on ski slopes where relatively large compressed air nozzles are employed to atomize water. In this application, the compressed air serves the additional purpose of diluting the spray plume by atmospheric entrainment with the large volumes of cold ambient air required to freeze the droplets. At low temperatures, relatively large droplets and relatively small volumes of compressed air may be employed, with the result that nozzle capacities in excess of 100 gpm. (400 lit./min.) have been attained. As the ambient wet bulb temperature increases, the droplet size requirements and liquid capacities rapidly decrease, and the air requirements increase, so that snowmaking operation becomes uneconomical much above 20 degrees F. (−7 C.).

Many atomization applications require a thorough and rapid intermixing with a large volume of secondary, or ambient gas. These include spray cooling of water, spray drying, combustion and spray washing. Forced draft blowers are often used for intermixing the spray and atmosphere. Because of the atmospheric entrainment produced by gas atomization, the prospect of its application becomes attractive if large liquid flow rates can be attained with control of the degree of atomization over a wide range of droplet sizes, with adequate spray dillution, and with economical power consumption.

SUMMARY OF THE INVENTION

In accordance with the present invention, a method and apparatus for gas atomizing is provided in which gas and a liquid to be atomized are formed under pressure into adjacent flowing sheets. Control of the length, width and thickness of the sheets is used to control spray droplet size, atmospheric spray dilution, and flow rates.

DESCRIPTION OF THE PREFERRED EMBODIMENTS

Annular Snowmaking Nozzle

Figure 1:
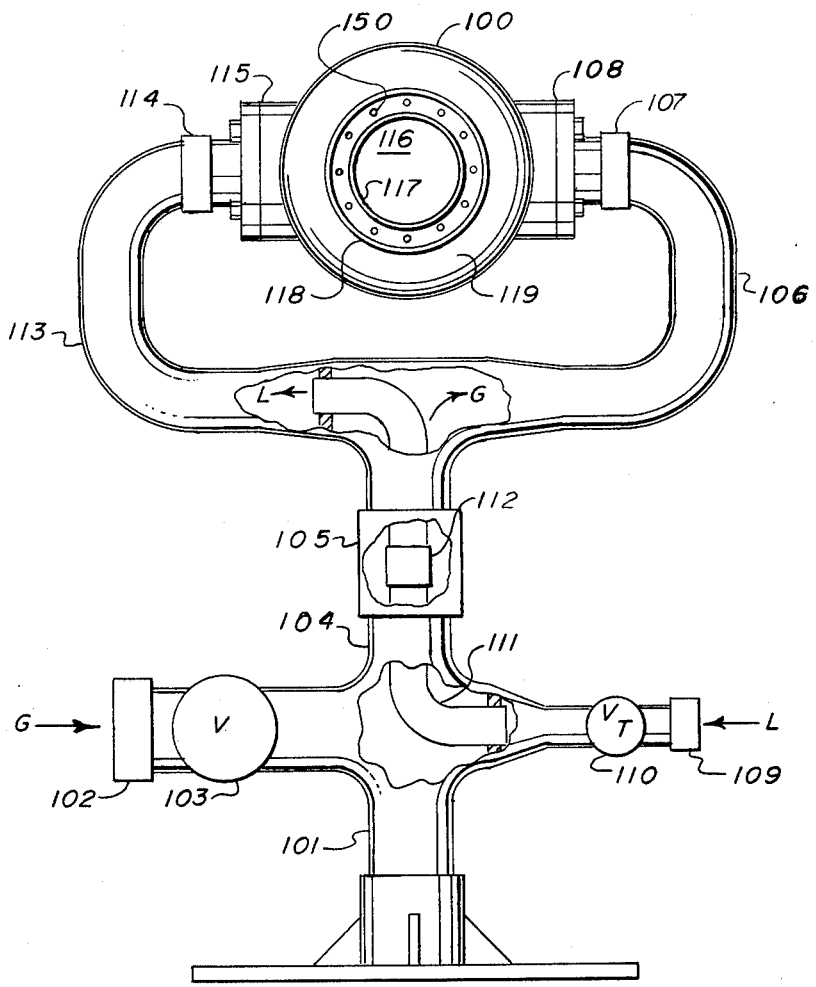
FIG. 1 shows an annular snowmaking nozzle as viewed from the rear, i.e., looking in the direction of spray, and as assembled with its gimbal type pipe stand with portions cut away.

FIGS. 1 through 6 illustrate an annular nozzle as developed for snowmaking in accordance with the method of atomization control of this invention, and generally designated by reference numeral 100. FIG. 1 shows annular nozzle 100 as viewed from the rear, i.e., looking in the direction of spray and as assembled with its gimbal type pipe stand 101 for sled or vehicle mounting and operation on a ski slope. As customarily practiced, compressed air G is delivered to gimbal stand 101 through hose coupling 102 and shut-off valve 103. The air then passes annularly up through outer column pipe 104 and outer column swivel joint 105, through yoke arm 106, swivel joint 107, and enters nozzle 100 at flange 108. Similarly, water L is delivered through hose coupling 109 and throttle valve 110, up inner column pipe 111, inner column swivel joint 112, through yoke arm 113 and swivel joint 114, and enters nozzle 100 at flange 115. Annular nozzle 100 has a central passage 116, formed by tubular inner nozzle wall 117, and open at both ends. The annular nozzle components are located concentrically between inner nozzle wall 117 and inner housing wall 118, which, in turn, is encased by water jacketed housing 119 to warm the outer surface of the nozzle 100, and, thereby, prevent ice or snow accumulation.

Figure 2:
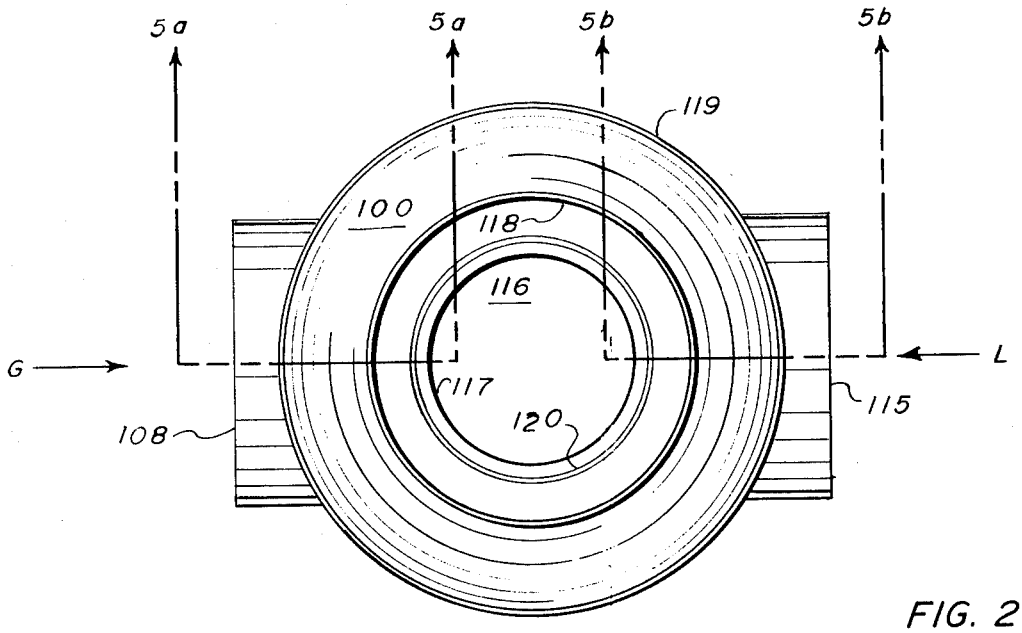
FIG. 2 is an enlarged elevation view of the nozzle portion of FIG. 1, as viewed from the front or spray face.

FIG. 2, which is an enlarged front elevation view of annular nozzle 100, shows the location of the annular exit opening 120 through which the water, as it is being atomized, passes together with the expanding compressed air.

Figure 3:
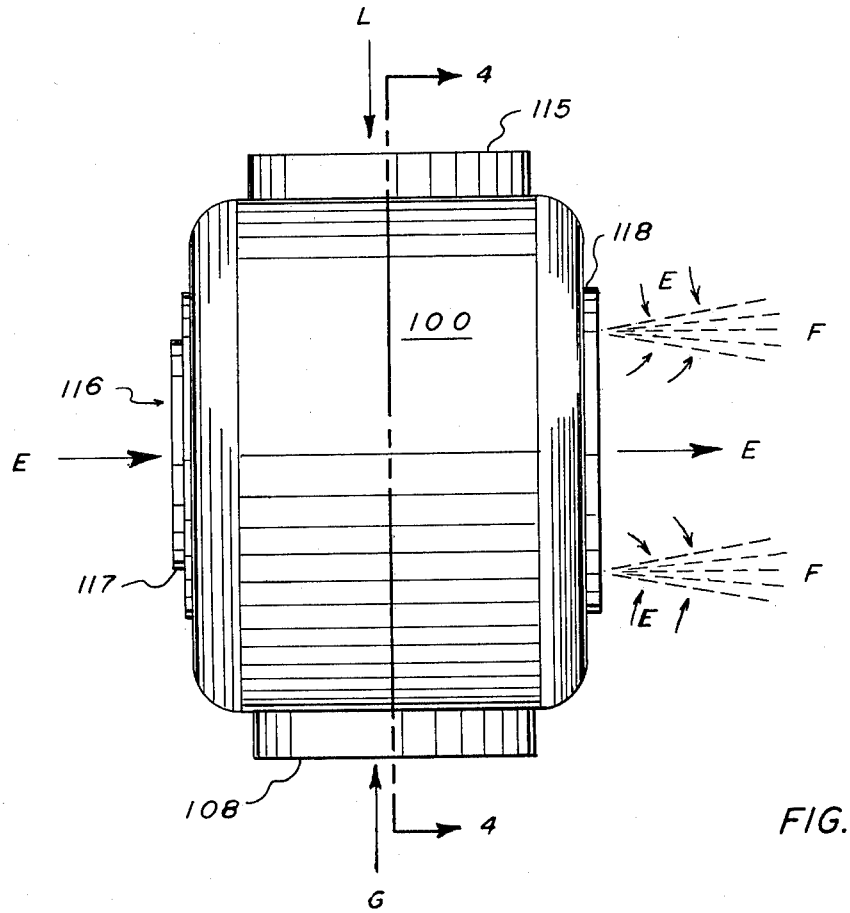
FIG. 3 is an enlarged plan view of nozzle portion of FIG. 1, rotated 90 degrees.

FIG. 3, which is an enlarged plan view of nozzle 100, illustrates the aspiration effect of the expanding annular mixture of air and water droplets, or spray plume F, as it exits from the front of the nozzle. Entrainment air E is not only drawn into the expanding plume F from around the outside of the nozzle, but is also drawn in through central passage 116 from the rear of the nozzle, to mix with expanding plume F along its central axis, so as to aid in diluting the spray with a minimum recirculation of aerosol, back along the nozzle axis.

Figure 4:
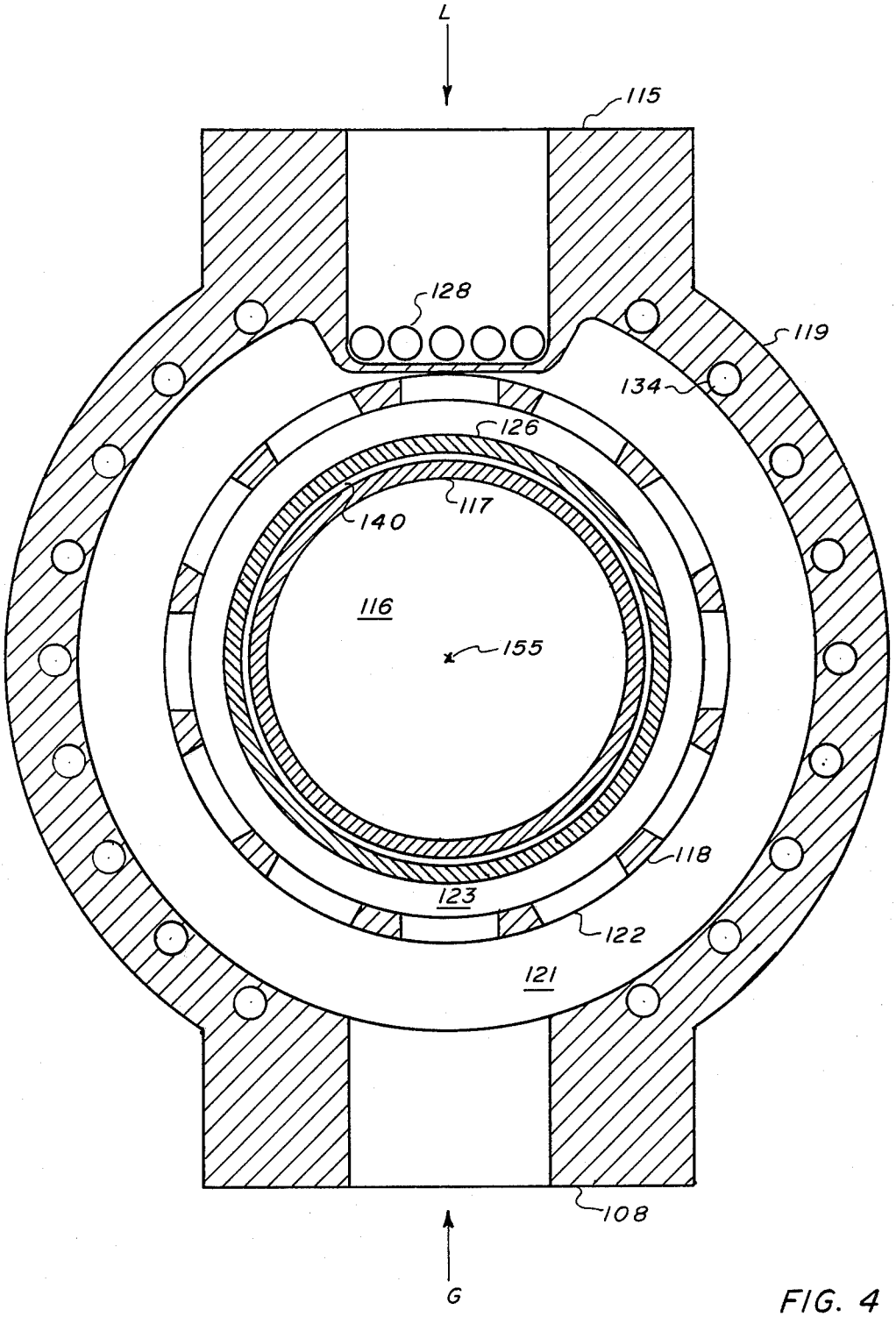
FIG. 4 shows section 4—4 of FIG. 3 enlarged two times.
Figure 5A:
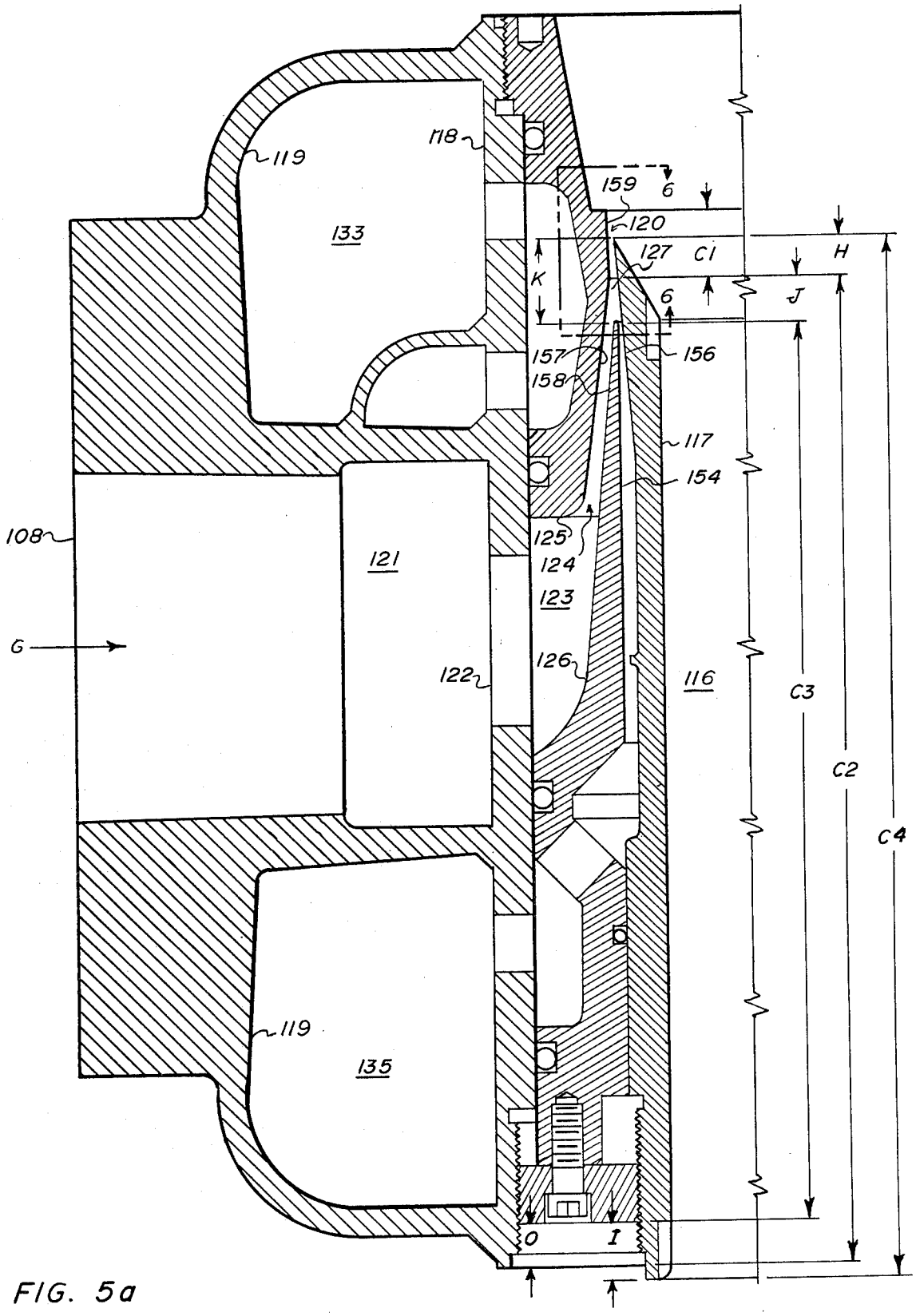
FIG. 5*a* shows section 5*a*—5*a* of FIG. 2, enlarged.
Figure 5B:
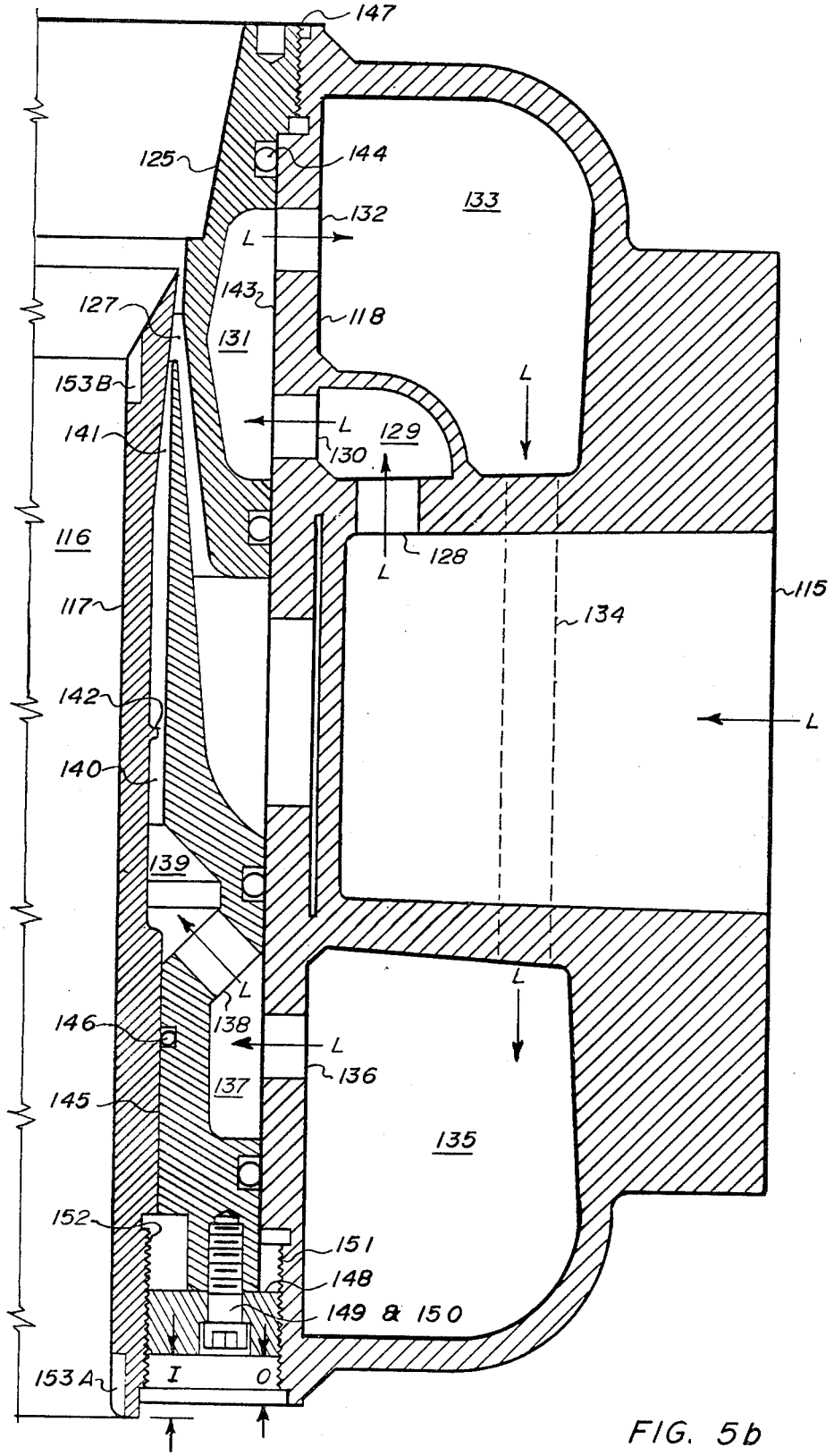
FIG. 5*b* shows section 5*b*—5*b* of FIG. 2, enlarged.

FIGS. 4 and 5 are enlarged sectional views of FIGS. 3 and 2 respectively. Referring to FIGS. 4 and 5A, compressed air G passes from entry flange 108 into outer air manifold 121, through twelve ports 122 to inner air manifold 123, along converging air annulus 124, formed by outer nozzle wall member 125 and nozzle dividing wall member 126, to converging common annulus 127, formed by outer nozzle wall member 125 and inner nozzle wall member 117. Referring to FIGS. 4 and 5B, water L passes from entry flange 115 through five ports 128 into annular water jacket manifold 129, thence, radially inward through twelve equally spaced ports 130 into outer nozzle wall manifold 131, to warm the surface of outer nozzle wall member 125, out through twelve ports 132 to front water jacket 133. The water then flows through eighteen ports 134 (shown rotated out of true position in FIG. 5*b* for illustration purposes) into rear water jacket 135, through twelve ports 136 into outer dividing wall manifold 137, through six ports 138 into inner dividing wall manifold 139, and along annular water feed channel 140 and converging water annulus 141, formed by dividing wall member 126 and inner wall member 117, to common, converging annulus 127. During its flow through annular feed channel 140, the water passes annular orifice restriction 142, which serves to increase the uniformity of flow, and warms the wall of central passage 116 to prevent ice accumulation.

Referring to FIG. 5*b*, outer wall member 125 and dividing wall member 126 are positioned radially by machined inner surface 143 of inner housing wall 118, and sealed by four O-rings 144. Inner nozzle wall member 117 is positioned radially by machined inner surface 145 of dividing wall member 126, and sealed by O-ring 146. Outer nozzle wall member 125 is locked in position axially by threads 147. Dividing wall member 126 is attached to threaded rear ring 148 by six equally spaced screws 149 at drilled and tapped holes 150. Rear ring 148 is positioned axially relative to inner housing wall 118 by threads 151, and relative to inner wall member 117 by threads 152. Rotation of rear ring 148 relative to inner housing wall 118, but not relative to inner nozzle wall member 117, changes the axial position of dividing wall member 126 and inner wall member 117 relative to outer wall member 125. Rotation of inner wall member 117, relative to rear ring 148 and inner housing wall 118, changes the axial position of inner wall member 117 relative to the position of dividing wall member 126 and outer wall member 125. The relative positions of the three nozzle wall members 117, 125 and 126, are indicated externally by inner and outer adjustment lengths I and O. Rotation of rear ring 148 is facilitated by attaching a suitable spanner wrench to six additional tapped holes 150. The twelve tapped holes 150 are shown in rear view, FIG. 1 of nozzle 100. Rotation of inner wall member 117 is accomplished by attaching a suitable spanner wrench at notches 153A or 153B.

As generally practiced (see Perry's Chemical Engineers' Handbook, 4th Ed., pgs. 18–59 through 18–68, McGraw-Hill, 1963), gas atomization may be defined as a process involving the following steps:

1. Forming, by means of a suitable nozzle or orifice, of a liquid filament or sheet which becomes detached, i.e., unsupported by any surrounding walls, to flow at relatively low velocity in contact with a relatively high velocity gas stream.
2. Breaking-up, or atomizing, the filament or sheet into discreet droplets as the result of its inherent instability in combination with its interaction with the gas stream.
3. Acceleration of the droplets by the gas stream.
4. Dilution of the spray by entrainment of the surrounding atmosphere by the flowing gas stream (op cit, pg. 5–18).

The method and means whereby independent control and variation of spray droplet size, gas consumption and liquid flow rate may be achieved with annular nozzle 100 are related to the manner of forming and varying an unsupported liquid sheet and an adjacent, atomizing gas sheet in the region of converging common annulus 127. As herein used, the terms liquid sheet and gas sheet refer to the portions of the respective flowing liquid and gas streams that are thin in comparison to their lengths and widths.

Figure 6:
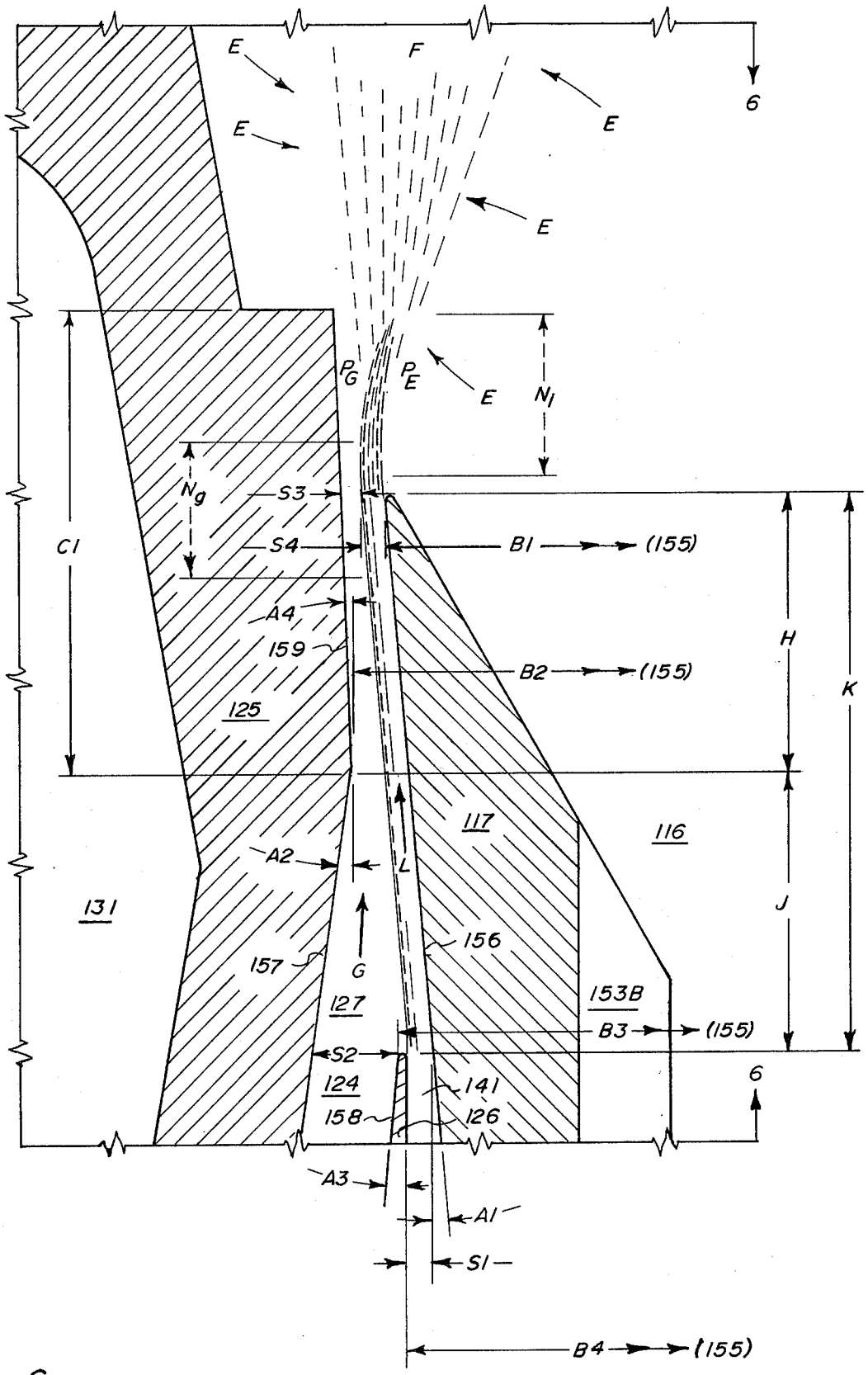
FIG. 6 is an enlarged view of the portion of FIG. 5 designated as 6—6.

FIG. 6, which is an enlarged view of the portion of FIG. 5 designated as 6—6, is presented, together with an approximate mathematical analysis of typical operating conditions and nozzle dimensions, in order to illustrate the method and means of atomization control.

Referring to FIGS. 5*a* and 6, the radial inner surface 154 of dividing wall member 126 is parallel to axis 155 (location indicated in FIG. 4) of central passage 116. The angles A1, A2 and A3 are the angles of convergence of surfaces 156, 157 and 158 of nozzle wall members 117, 125 and 126, respectively, relative to surface 154. Angle A4 is the angle of divergence of surface 159 of outer wall member 125 relative to surface 154. Dimension B1 is the radius at the end of inner nozzle wall member 117, from axis 155. Dimension B2 is the corresponding radius of outer wall member 125 at the intersection of angles A2 and A4. Dimensions B3 and B4 are the corresponding outer and inner radii at the end of dividing wall member 126. Lengths CI, C2, C3 and C4 are fixed axial nozzle dimensions, as indicated in FIG. 5*a*. The relative axial positions of nozzle wall members 117, 125 and 126, in the region of converging common annulus 127, are designated as the variables H, J and K, and are related to the external adjustment lengths, I and O, by the axial nozzle dimension C1, C2, C3 and C4. The dimension S1 is the radial width of the converging water annulus 141 at the end of dividing wall member 126. The dimension S2 is the minimum radial width of converging air annulus 124. The dimension S3 is the minimum radial width of the flowing air sheet within converging common annulus 127. The dimension S4 is the radial width of the water sheet at the end of inner nozzle wall member 117. When, as in the case of nozzle 100, the gas and liquid flow directions are both nearly parallel to axis 155 of central passage 116, S4 is approximately equal to S1, and to the thickness of the unsupported water sheet at its point of formation at S4 (i.e., cosine of angle A4 = 1, approximately).

The atomization of liquid L in nozzle 100 occurs substantially in annular region $N_1$ of FIG. 6, starting at about the end of nozzle wall member 117 and extending downstream for a distance which varies with the liquid and gas sheet thicknesses, flow conditions and physical properties. Entrainment air E enters annular plume F from central passage 116, starting immediately upon occurrence of sufficient liquid sheet disintegration to allow penetration through the liquid stream into the expanding gas stream, and continuing down stream until the annular plume has expanded to axis 155. Entrainment air E is also drawn in from around the outside of the nozzle to mix with expanding air G near the region of atomization. As herein used, entrainment air E refers to fresh air from the surrounding atmosphere, termed secondary air, that does not contain a significant amount of recirculated spray droplets. As the unsupported liquid sheet is disintegrating in region $N_l$, it is also deflected radially inward toward axis 155 by the pressure difference, $P_G$–$P_E$, between the pressure within the expanding air, $P_G$, and the pressure of the entrainment air, $P_E$.

For the convenience of the mathematical analysis, variables H, J and K are defined by equation 1, 2 and 3 of Table I. The variable H may have both positive and negative values, depending upon the values of C2, C4, I and O, and if B2 is greater than BI. Similarly, the variable J may have both positive and negative values if B2 is greater than B3. The variable K is limited to positive values if BI is greater than B4. Equations 4 through 10 of Table I show the relationships between C1, H, J, K, S1, S2 and S3 when K is positive and S1 = S4.

The primary variable affecting the degree of atomization in the typical range of operation of nozzle 100 is water sheet thickness S1, which varies with K in accordance with equation 4, and is intentionally made to be of a thickness which is of the same order of magnitude as the desired spray droplet size. The quantity of water L, flowing, is determined by the water supply pressure and water sheet width S1. The quantity of compressed air supplied is determined by the air pressure and the minimum width of the air annulus, which is approximately S2 or S3, whichever is smaller. When S3 is less than S2, and H is less than C1, the point of maximum mass flow rate of compressed air per unit cross-sectional area (maximum mass velocity) of annular nozzle 100, i.e., the air nozzle throat occurs at about the same axial position as the point of formation of the unsupported water sheet, i.e., at S4; equations 7 and 8 apply, and the air flow rate is a function of both I and O. If significant liquid sheet thinning occurs within converging common annulus 127, as the result of liquid sheet acceleration or atomization from wave action at the liquid-gas interface, the actual throat may be located somewhat upstream of the end of converging common annulus 127. The actual throat may also occur at a somewhat downstream position when the liquid and gas streams continue to converge as directed by the converging inner and outer nozzle wall surfaces 156 and 159 or when liquid sheet deflection starts somewhat downstream of the end of inner wall 117. Since the actual throat is of somewhat uncertain position, it is referred to as an effective throat zone, $N_g$, which is defined as herein used as a zone in which the mass velocity of the gas stream is within 90% of maximum, or effectively at its maximum value. When equations 5, 6, 9 or 10 determine the minimum compressed air sheet width, the unsupported water sheet is formed at a point downstream of the nozzle throat, and in a region of decreasing mass flow rate of compressed air per unit cross-sectional area. The compressed air flow rate then varies with O, and is independent of I, and S1.

Typical dimensions of nozzle 100, as employed in snowmaking, are shown in Table II together with approximate equations for estimating the air flow rate, $Q_a$, the water velocity, $V_w$, and the water flow rate, $Q_w$, with sonic air velocity and negligible flow friction in the nozzle. The results of application of the equations and dimensions of Tables I and II are presented in Table III for several typical adjustments of K, showing the range for which equations 7 and 8 apply. The calculations were made for constant air pressure and constant water pressure. The droplet diameter, D, expressed in microns, is defined for the purpose of these calculations as that of a droplet having a diameter equal approximately to the thickness of water sheet S1. A correlation of D with the mean, or other statistically representative droplet diameter of spray plume F is not intended. Air flow rates are for three groups of H values. In the first group, J is set near its maximum value. In the second group, H = O, which is the minimum air flow rate condition. In the third group, H is set at about the maximum value for which S3 is less than S2.

TABLE I

| NOZZLE ADJUSTMENT EQUATIONS - Nozzle 100 | |
|---|---|
| H = C4 − C2 + O − I | Eq. (1) |
| J = C2 − C3 − O | Eq. (2) |
| K = C4 − C3 − I = H + J | Eq. (3) |
| S1 = K tan(A1) + B4 − B1 | Eq. (4) |
| S2 = B2 − B3 + J tan(A2), when J is positive. | Eq. (5) |
| S2 = B2 − B3 + J tan(A3), when J is negative. | Eq. (6) |
| S3 = B2 − B4 − K tan(A1) − H tan(A2), when H is negative. | Eq. (7) |

TABLE I-continued

| NOZZLE ADJUSTMENT EQUATIONS - Nozzle 100 | |
|---|---|
| S3 = B2 − B4 − K tan(A1) + H tan(A4), when H is positive, H is less than C1 and A4 is less than A1. | Eq. (8) |
| S3 = B2 − B4 − J tan(A1) − C1 tan(A1) + C1 tan(A4), when H is greater than C1 and A4 is less than A1. | Eq. (9) |
| S3 = B2 − B4 − J tan(A1), when A4 is greater than A1 and H is positive. | Eq. (10) |

TABLE II

DIMENSIONS AND FLOW EQUATIONS - Nozzle 100

| | |
|---|---|
| Angle A1 = 5 degrees | Radius B1 = 3.136 inches |
| Angle A2 = 8 degrees | Radius B2 = 3.183 inches |
| Angle A3 = 5 degrees | Radius B3 = 3.136 inches |
| Angle A4 = 2 degrees | Radius B4 = 3.126 inches |

Axial length C1 = $\frac{3}{8}$ inches

The volumetric flow rate of an ideal gas may be expressed by:

$$Q_g = \left[\left(\frac{gkR}{T_gM}\right)\left(\frac{2}{k+1}\right)^{\frac{k+1}{k-1}}\right]^{\frac{1}{2}} \cdot \left(\frac{T_s}{P_s}\right) A_t \cdot P_g' \quad \text{Eq. (11)}$$

from which: $Q_a = 350\ S_t\ (P_a + P_s)$, scfm. air Eq. (12)

where: g = gravitational constant k = ratio of specific heats

R = gas law constant

M = molecular weight $T_g$ = gas supply temperature = 500 deg. R., assumed $T_s$ = std. temp. = 492 deg. R.

$P_a = P_g$ = air supply pressure, psig. = $P_g' - P_s$ $P_s$ = standard atmosphere = 14.7 psia.

$A_t$ = gas throat area = $\pi D_t \cdot S_t$ $D_t$ = diameter at gas throat = 6.3 in., avg.

$S_t$ = air annulus width at throat, inches

The initial velocity and flow rate of the liquid sheet may be expressed by:

$$Q_1 = A_1 \cdot V_1 = A_1 \cdot \left[\left(\frac{2g}{d_1}\right)(P_1 - P_e)\right]^{\frac{1}{2}} \quad \text{Eq. (13)}$$

from which: $V_w = 12.2\ (P_w' - k_1P_g')^{\frac{1}{2}}$, ft/sec. Eq. (14)

and $Q_w = 61.5\ (S1)\ V_w$, gpm. Eq. (15)

where: $d_1$ = water density, 62.4 lb/ft.$^3$ $P_w = P_1$ = water supply pressure, psig. = $P_w' - P_s$ $P_e = k_1(P_a + P_s) - P_s$ = water pressure in common annulus 127, psig.

$k_1$ = 0.53 to 1.0 = 0.8 avg., assumed $A_1 = \pi D_1(S_1 = S1)$, and $D_1$ = 6.3 in., approx., avg.

TABLE III

TYPICAL OPERATING CONDITIONS - Nozzle 100

| | | | | | | |
|---|---|---|---|---|---|---|
| D, microns | 125 | 200 | 300 | 475 | 750 | 1200 |
| K, in. | 11/64 | 13/64 | $\frac{1}{4}$ | 21/64 | 29/64 | 21/32 |
| S1, in. | .005 | .008 | .012 | .019 | .030 | .048 |
| $Q_w$, gpm. | 40 | 60 | 90 | 140 | 220 | 360 |
| H, in. | −37/64 | −35/64 | $-\frac{1}{2}$ | −27/64 | −19/64 | −3/32 |
| S3, in. | .123 | .116 | .105 | .087 | .059 | .013 |
| $Q_a$, scfm. | 5000 | 4700 | 4200 | 3500 | 2400 | 500 |
| $R_f = Q_a/Q_w$ | 125 | 78 | 47 | 25 | 11 | 1.4 |
| H, in. | 0 | 0 | 0 | 0 | 0 | 0 |
| S3, in. | .042 | .039 | .035 | .028 | .017 | 0 |
| $Q_a$, scfm. | 1700 | 1600 | 1400 | 1100 | 700 | 0 |
| $R_f = Q_a/Q_w$ | 42 | 27 | 16 | 8 | 3 | 0 |
| H, in. | 5/32 | 13/64 | 17/64 | $\frac{3}{8}$ | 9/16 | $\frac{5}{8}$ |
| S3, in. | .047 | .046 | .044 | .041 | .037 | .021 |
| $Q_a$, scfm. | 1900 | 1850 | 1800 | 1700 | 1500 | 900 |
| $R_f = Q_a/Q_w$ | 48 | 31 | 20 | 12 | 7 | 2.5 |

$P_a$ = 100 psig. $P_w$ = 177 psig. $V_w$ = 122 ft/sec.

D, microns = 25000 S1, approx.

As indicated in Table III and as supported by snowmaking field test data, considerable variation in the air-to-water ratio $R_f$, can be achieved for a constant diameter D. The air and water flow rates can be varied independently by varying air and water pressures. By combined variations of nozzle adjustment and fluid pressures, independent variation of D, at constant air and water flow rates, can be achieved. Several secondary effects and limitations are recognized. Variation of $Q_a$, at constant air pressure, will affect droplet size to some extent; however, tests indicate the effect to be small, except at low values of $R_f$ when insufficient gas energy is available for atomization or when droplet collision and growth may become significant. Values of $R_f$ applicable to snowmaking practice range approximately from $R_f$=5 to $R_f$=30. The change in air density at the nozzle throat, which results from air pressure changes, also affects droplet diameter; however, reducing air pressure by a factor of two relative to the value of $P_a$ of Table III, does not appear to produce a major change in droplet diameter as indicated by observing resulting snow dryness. In general, the effect of velocity on the degree of atomization is a function of the difference in velocity between the liquid and gas streams. High water velocities will increase the droplet size. Low water velocities appear to produce some reduction in droplet size, probably as the result of liquid sheet thinning and atomization by surface wave action within converging common annulus 127. When the air velocity is sonic at zone $N_g$, changes in water velocity within the range 5–15% of the air velocity have not significantly affected droplet size. Formation of the unsupported water sheet in a region of supersonic air velocity (when angle A4 is greater than angle A1, and H is positive) in a convergent-divergent gas nozzle has not been found to be beneficial. The presence of discontinuities produced by the liquid sheet apparently causes shock waves and immediate gas velocity reduction to subsonic. The shock waves also promote undesirable noise. Since atomization at zone $N_g$ was found to be optimum, the preferred configurations and adjustments of nozzle 100 are those for which equations 7 and 8 apply, and zone $N_g$ occurs at region $N_l$.

Although droplet size data has not been obtained for nozzle 100, mass and heat transfer calculations have indicated that the useful droplet sizes for snowmaking range from about 100–400 microns under mild ambient conditions to around 800 microns under very cold conditions. Useful droplet sizes were considered to be those large enough to not blow off in the wind, and small enough to freeze before settling to the ground. The upper limit is determined primarily by the settling rate and the spray trajectory height of plume F. The applicable range of adjustment of S1 in nozzle 100 is considered to be about 0.004" to 0.04", or 0.01 to 0.1 centimeters.

Changing the radius B1 can be utilized to increase or decrease the size of nozzle 100, and thus, its liquid capacity. As B1 is decreased, however, the flow of entrainment air E through central passage 116 decreases in proportion to the square of B1. Plugging up passage 116 increased the liquid sheet deflection in region $N_l$ and produced poor quality (wet) snow. The upper limit of nozzle size for snowmaking application is a function of the volume of ambient space receiving the large quantity of heat transferred in freezing the water, which, in turn, is limited by the wind velocity, spray trajectory (length of plume F) and the ambient temperature and humidity. As a practical limit, the size range of nozzle 100, expressed in terms of radius B1 is considered to be about 0.75" to 7.5", or 2 to 20 centimeters.

Figure 7:
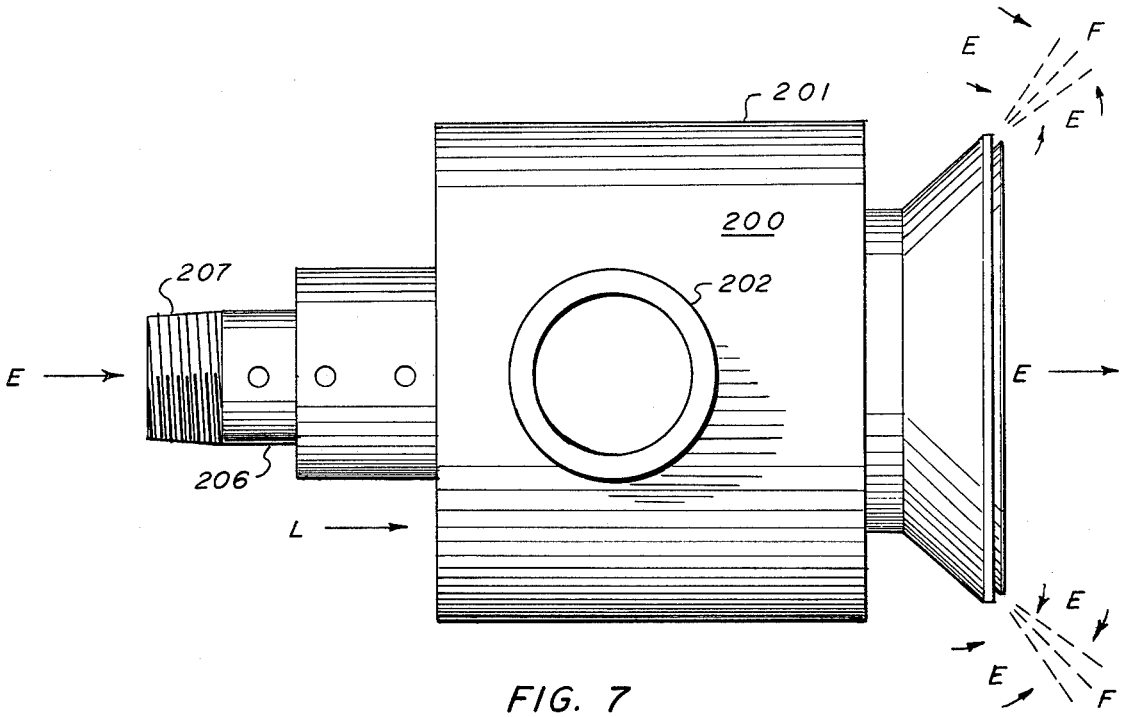
FIG. 7 is a plan view of an annular nozzle as devised from atomization of viscous liquids or slurries.
Figure 8:
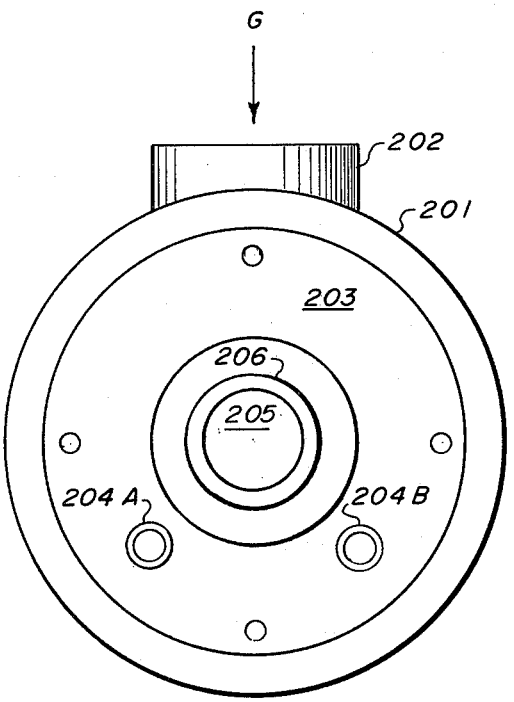
FIG. 8 is a rear elevation view of the nozzle of FIG. 7.
Figure 9:
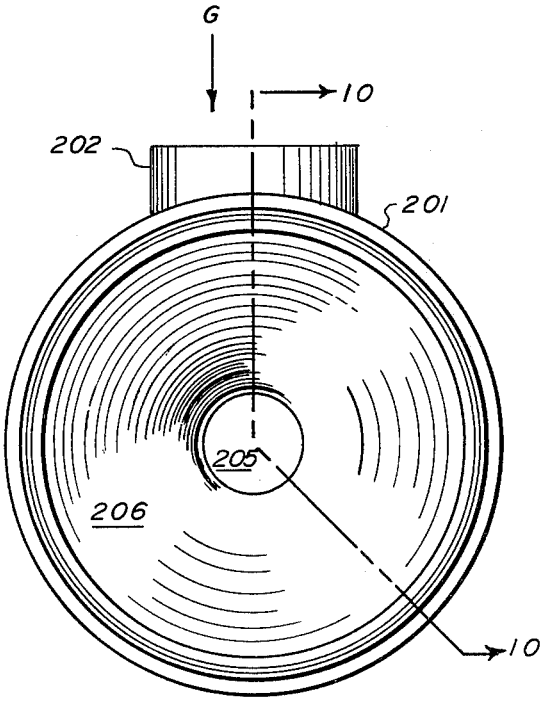
FIG. 9 is a front (or spray exit) elevation view of the nozzle of FIG. 7.

FIGS. 7 through 11 illustrate an annular nozzle with two conically flowing gas sheets and one conically flowing liquid sheet, as devised for atomization of viscous liquids or slurries (i.e. liquids containing suspended solids) such as in combustion of heavy oils and coal-oil mixtures, in accordance with the method of atomization control of this invention, and designated generally by numeral 200. Referring to FIGS. 7, 8 and 9, which are plan, rear and front, or exit, elevation views, respectively, of nozzle 200, compressed air G is delivered through the top of housing member 201 at threaded pipe connection 202. Liquid L is delivered from a source and pressurizing means through rear wall and support member 203 at pipe tap 204A. An additional pipe tap, 204B, may be provided to allow for recirculation of liquid L to the source, when desired for liquid heating and flow control purposes. Nozzle 200 has a central passage 205, formed by inner nozzle wall member 206, through which entrainment air E is delivered, at threaded end 207, from a secondary, low pressure source, such as a blower, to flow through nozzle 200 and mix immediately with conically exiting plume F.

Figure 10:
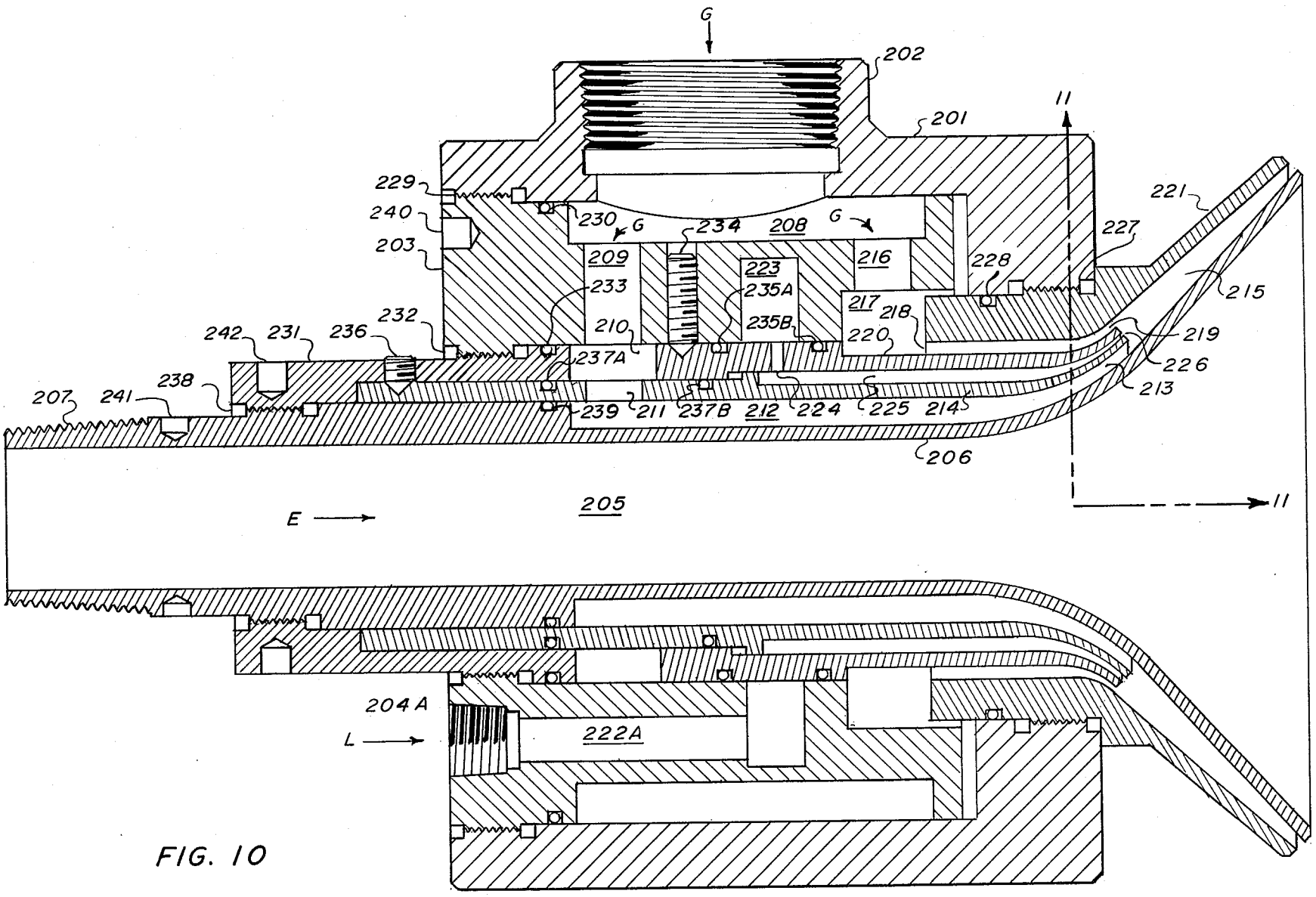
FIG. 10 shows section 10—10 of FIG. 9 enlarged two times.

Referring to FIG. 10, which is a sectional view of FIG. 9, compressed air G is distributed around the interior of housing member 201 by outer air manifold 208, radially inward through six ports 209 to rear inner manifold 210, through six additional ports 211 into inner air feed channel 212 and inner converging air annulus 213, formed by inner nozzle wall member 206 and inner dividing wall member 214, to converging common annulus 215. Additional compressed air G is fed through six radial ports 216 into front, inner manifold 217, outer air feed channel 218 and outer converging air annulus 219, formed by outer dividing wall member 220 and outer nozzle wall member 221, to converging common annulus 215. Liquid L is fed through port 222A to liquid manifold 223, through six radial ports 224 to liquid feed channel 225 and converging liquid annulus 226, formed by inner and outer dividing wall members 214 and 220, to converging common annulus 215. Where recirculation of liquid L is desired, a second feed port (identical to 222A) is added, leading from liquid manifold 223 to pipe tap 204B.

Outer nozzle wall member 221 is connected to housing 201 by threads 227, and sealed by O-ring 228. Rear wall and support member 203 is connected to housing 201 by threads 229, and sealed by O-ring 230. Rear tubular support member 231 is connected to rear wall and support member 203 by threads 232, and sealed by O-ring 233. Outer dividing wall member 220 is locked to rear wall and support member 203 by set screw 234, and sealed by O-rings 235A and 235B. Inner dividing wall member 214 is locked to rear tubular support member 231 by set screw 236, and sealed by O-rings 237A and 237B. Inner nozzle wall member 206 is connected to rear tubular support member 231 by threads 238, and sealed by O-ring 239.

Figure 11:
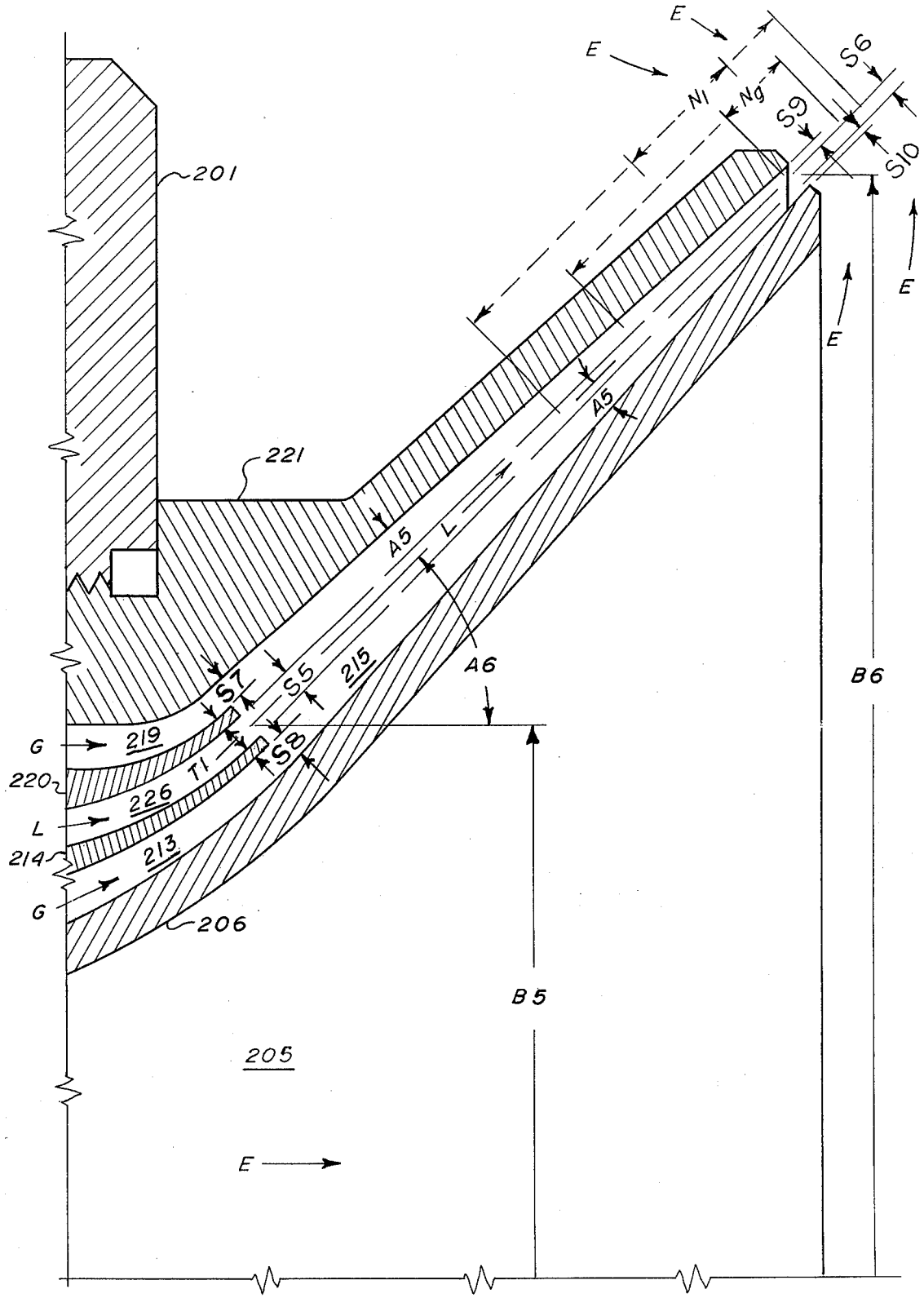
FIG. 11 is an enlarged view of the portion of FIG. 10 designated as 11—11.

Referring to FIG. 10, and to FIG. 11, in which the portion of FIG. 10 showing the converging annuli 213, 215, 219 and 226 is enlarged three times, liquid L enters converging common annulus 215 as an unsupported, conically flowing sheet of thickness S5. As it flows outward, its thickness is reduced until it emerges from the end of the nozzle, at the termination of converging common annulus 215, with a maximum sheet thickness S6. Compressed air G enters converging common annulus 215 in the form of two converging air sheets of thicknesses S7 and S8, flowing adjacent to and on opposite sides of the unsupported liquid sheet. Inner and outer air feed channels 212 and 218 are sized so that the flow friction and pressure drops are approximately equalized. Nozzle 200 is adjusted so that the two flowing air sheets enter converging common annulus 215 with sheet widths S7 and S8 approximately equal. The surfaces of converging common annulus 215 converge at a small angle, A5, relative to the divergence angle, A6, of the conically flowing liquid sheet. The end or tip wall thicknesses of inner and outer dividing wall members 214 and 220, both designated as T1, are made as small as practical to minimize flow disruption, and equal, so that the flowing air sheet thicknesses, S9 and S10, at the end of inner and outer nozzle wall members 206 and 221, are approximately equal when $S7=S8$. Nozzle 200 is also adjusted, when no liquid is flowing, so that the gas nozzle throat occurs at the end of common annulus 215, i.e. $(B5)\cdot(S7+S8)$ is greater than $(B6)\cdot(S9+S10)$, and $S6=0$.

Rotation of rear wall and support member 203, relative to housing 201, varies air sheet thicknesses S7 and S9. Rotation of rear tubular support member 231, relative to rear wall and support member 203, varies the thickness, S5, of the unsupported liquid sheet. Rotation of inner nozzle wall member 206, relative to rear tubular support member 231, varies air sheet thicknesses S8 and S10. Rotation of components 203, 206 and 231 may be accomplished by the use of spanner wrenches which engage holes 240, 241 and 242, respectively. Rotation may be facilitated by the use of flexible liquid feed and return tubing attached to pipe taps 204A and 204B, and by the addition of a swivel joint or union at threaded end 207.

The method of atomization control with conically flowing nozzle 200 is generally similar to that of nozzle 100. With nozzle 200, however, the initial thickness, S5, of the unsupported liquid sheet is made relatively large compared to the desired spray droplet size to permit the passage of solid particles, when they are present in the liquid. With coal-oil mixtures, for example, solid particle sizes up to about 0.1 inch, or 0.25 cm., are anticipated. With viscous liquids or mixtures flowing initially (at S5) under laminar conditions, the unsupported liquid sheet persists for a considerable distance before breaking up. The ratio of liquid sheet thicknesses, S6/S5, depends upon the ratio of nozzle radius B5, at S5, to nozzle radius B6, at S6, i.e., the amount of sheet thinning from mass conservation during conical flow, and upon the amount of liquid acceleration and break-up into droplets which occurs within converging common annulus 215 as the result of the action of the two adjacent high velocity air streams, G, and the liquid sheet instability. As an upper limit, assuming no liquid acceleration or break-up, S6=(S5)·(B5)/(B6). If complete break-up occurs, exit sheet thickness S6=0. The conical sheet flow within converging common annulus 215 serves as an aid to thinning the unsupported liquid sheet prior to break-up. By employing the small convergence angle, A5, the flow directions of the air sheets are essentially parallel to that of the liquid sheet, and the air velocity is maintained relatively high compared to that of the liquid throughout the length of converging common annulus 215. The length of the unsupported liquid sheet prior to break-up and the resulting droplet sizes vary with the physical properties of the liquid, the initial liquid and air sheet thicknesses, S5, S7 and S8, the liquid and air velocities, and the air pressure. The length of the zone of effective maximum mass velocity, $N_g$, also varies considerably, depending upon S5, S7 and S8, and the length of the region of atomization $N_l$. Atomization may start upstream of zone $N_g$ and continue somewhat beyond it. The approximate ranges of variation of $N_g$ and $N_l$ are indicated in FIG. 11. The occurrence of droplet impingement on the walls of converging common annulus 215 will result in liquid sheet flow along the walls and reatomization from unsupported liquid formation at the end of annulus 215. The length of converging common annulus 215 is selected so that the atomization with viscous fluids occurs substantially in zone $N_g$.

In order to illustrate the method and means of atomization control with nozzle 200, in a viscous fuel combustion application, some typical operating conditions are presented in Table IV for several values of S5, together with the equations and nozzle dimensions employed in their calculation.

TABLE IV

TYPICAL OPERATING CONDITIONS - Nozzle 200

| | | | | | | |
|---|---|---|---|---|---|---|
| B6, in. | 3 | 3 | 3 | 6 | 6 | 6 |
| S5, in. | .02 | .04 | .06 | .08 | .10 | .12 |
| $S7_1$, in. | .081 | .081 | .081 | .304 | .304 | .304 |
| $Q_{a1}$, scfm. | 200 | 400 | 600 | 1900 | 2400 | 2800 |
| $Q_{l1}$, gpm. | 3 | 6 | 9 | 12 | 15 | 18 |
| $V_{l1}$, ft/sec. | 5 | 5 | 5 | 5 | 5 | 5 |
| $S7_2$, in. | .142 | .122 | .102 | .352 | .338 | .324 |
| $Q_{a2}$, scfm. | 1850 | 1500 | 1200 | 4500 | 4200 | 4000 |
| $Q_{l2}$, gpm. | 15 | 15 | 15 | 22 | 22 | 22 |
| $V_{l2}$, ft/sec. | 25 | 12.5 | 8.3 | 9.2 | 7.3 | 6.1 |
| S6, avg, in. | .005 | .01 | .015 | .01 | .0125 | .015 |
| $D_6$,microns | 250 | 500 | 750 | 500 | 625 | 750 |

$$S_t = S9 + S10 = 2(T1) - 2\left(\frac{B6 - B5}{\sin(A6)}\right)\tan(A5) + S5 + S7 + S8 - S6 \quad \text{Eq. (16)}$$

From Equations 11 and 13, Table II:

$$Q_a = 4500\,(B6)\,S_t \quad \text{Eq. (17)}$$

$$Q_l = 30\,(S5)\,V_l \quad \text{Eq. (18)}$$

where: $T_g$ = 610 deg. R. = 150 deg. F. $D_l = 2\,(B5)$ $P_g$ = 30 psig. $S_l = S5$ Angle A5 = 3 degrees Radius B5 = 1.5 inches Angle A6 = 45 degrees Width T1 = .03 inches Where relatively large values of S5 are required to pass solid particles, radius B6 has been increased to allow for completion of the atomization. Since the distance required to accelerate the droplets to equilibrium with the air stream is significant, the increases with droplet size, impingement between smaller and larger droplets can occur within the nozzle. The presence of droplets which have not been accelerated to equilibrium upon reaching the throat results in an effective value of S6 that is greater than zero, even if complete atomization has already occurred. As an approximation, therefore, an average value of S6=(S5)·(B5)/2(B6) has been assumed in calculating average air flow rates. In order to indicate the limits of nozzle adjustment in the presence of solid particles the minimum average and maximum average air flow rates, $Q_{a1}$ and $Q_{a2}$, are tabulated together with the corresponding minimum (S7.) and maximum ($S7_2$) settings of S7. $S7_1$ is the value of S7 at S5=S9+S10+S6, when S6=0. $S7_2$ is the maximum value of S7 for which the nozzle throat occurs at the nozzle exit, i.e., at 2(S7)·(B5)=(B6) (S9+S10+S6), and B6=0. The corresponding liquid flow rates and velocities were selected to illustrate the range of variation for which the degree of atomization should not vary significantly at constant S5. Since statistically representative mean droplet sizes of the resulting sprays have not been determined, a hypothetical droplet diameter, $D_6$, equal to twice the assumed average value of S6, expressed in microns, is used to illustrate the anticipated order of magnitude of droplet sizes, neglecting the presence of large solid particles.

Figure 12:
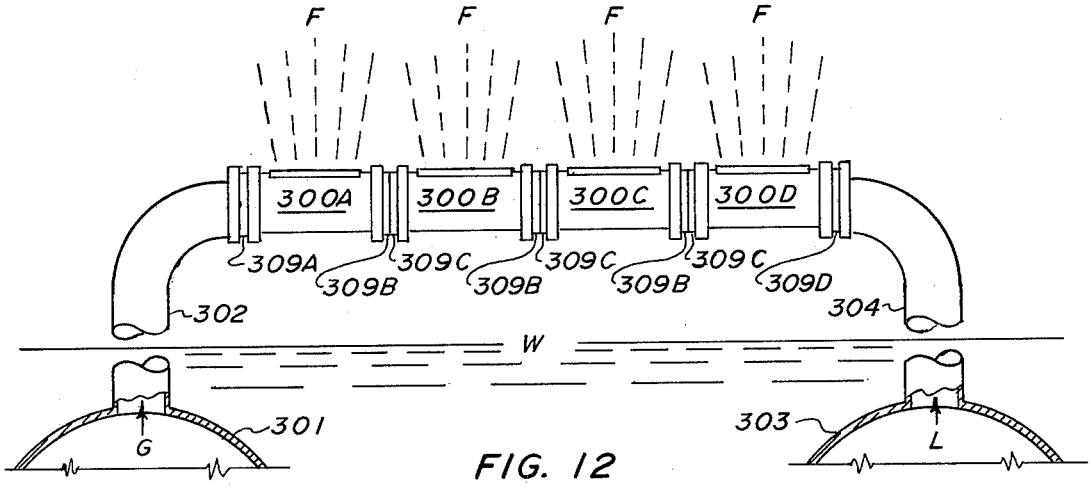
FIG. 12 shows an assembly of four linear sheet forming nozzles as devised for spray cooling of power plant condenser water effluent.

FIGS. 12 through 21 illustrate a nozzle with a linearly elongated configuration, two planar liquid sheets and one planar gas sheet, as devised for spray cooling of power plant condenser water in accordance with the method of atomization control of this invention, and designated generally by numeral 300. FIG. 12 shows a side elevation view of an assembly of four linear nozzles, designated individually as 300A, 300B, 300C and 300D, as typically installed to cool the warmed condenser water effluent L by spraying upwards over a river, ocean or other body of water W from which the cooling water is drawn into the power plant. Compressed air G is delivered to nozzle 300 through a submerged air main 301, from which is tapped a vertical standpipe assembly 302. Effluent L is delivered directly from the power plant to nozzle 300 through a submerged water main 303 into a vertical standpipe assembly 304. Additional standpipe assemblies, 302 and 304, are tapped at suitable intervals along delivery mains 301 and 303 to supply additional nozzle 300 assemblies, as required to meet the power plant capacity.

Figure 13:
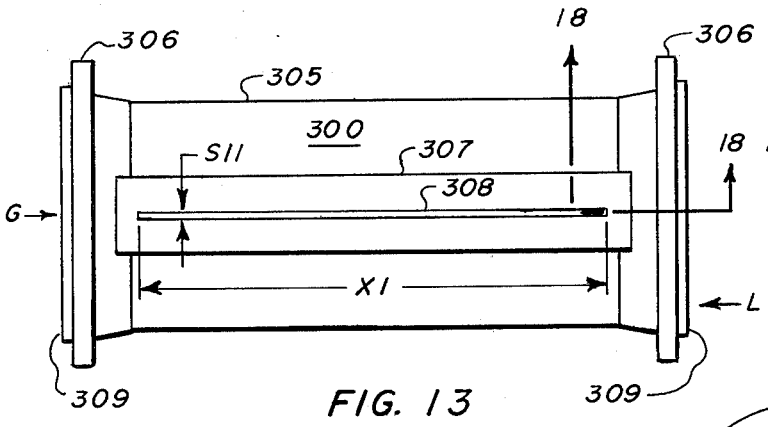
FIG. 13 is a plan view of one nozzle of FIG. 12 enlarged four times.
Figure 16:
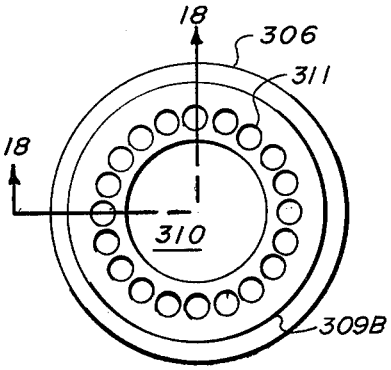
FIG. 16 is a right side elevation view of the first nozzle, a right or left side elevation view of the second or third nozzle, or a left side elevation view of the fourth nozzle of FIG. 12 enlarged four times.
Figure 15:
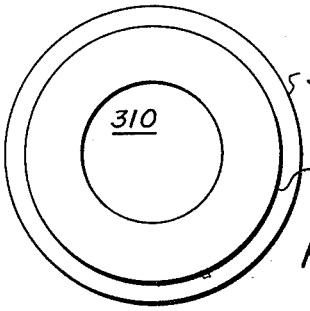
FIG. 15 is a left side elevation view of the first nozzle, i.e., at the left end, of the nozzle assembly of FIG. 12 enlarged four times.
Figure 14:
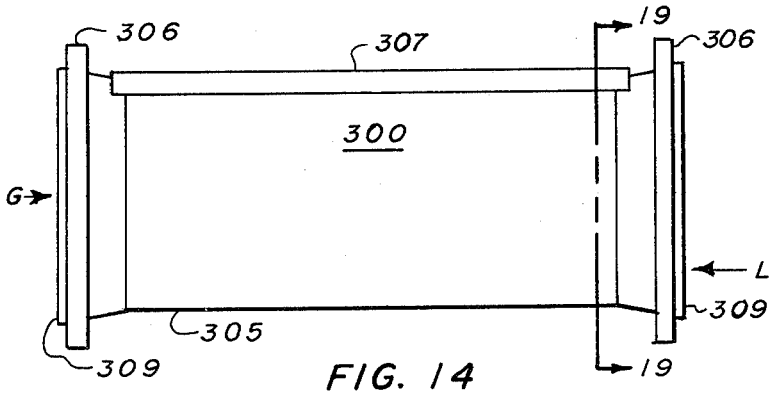
FIG. 14 is a side elevation view of one nozzle of FIG. 12 enlarged four times.
Figure 17:
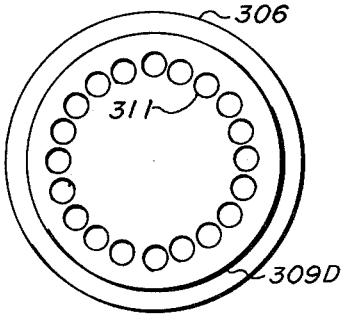
FIG. 17 is a right side elevation view of the fourth nozzle of FIG. 12 enlarged four times.

FIGS. 13 through 17 show the external features of nozzle 300. FIGS. 13 and 14 are plan and elevation views, respectively, of nozzle 300, as shown in FIG. 12, but enlarged four times. Nozzle 300 includes an outer pipe wall 305 with a welding neck flange 306 at each end, plus a face plate 307 welded in place of a portion of outer pipe wall 305 and welding necks of flanges 306. Face plate 307 contains opening 308, which terminates at its exterior surface in the form of a slit of length X1 in a longitudinal direction, referred to herein as the X axis of nozzle 300, and width S11 in a direction perpendicular to the X axis and to the upward spray direction, referred to herein as the Z axis of nozzle 300. Attached to each end of nozzle 300 is a closure plate 309, of which there are four variations, designed individually as 309A, 309B, 309C and 309D. Nozzle 300A includes closure plates 309A and 390B. Nozzles 300B and 300C include closure plates 309B and 309C. Nozzle 300D includes closure plates 309C and 309D. FIG. 15 is an end view of nozzle 300A looking from the flanged junction with compressed air standpipe 302, showing closure plate 309A, which has a single central opening 310 for passage of compressed air G. FIG. 16 is an end view of the opposite end of nozzle 300A, showing closure plate 309B, which includes, in addition to central opening 310, a multiplicity of openings 311 for passage of effluent L annularly to central opening 310. Closure plate 309C is similar to 309B in that it includes openings 310 and 311. FIG. 17 is an end view of nozzle 300D looking from the flanged junction with effluent standpipe 304, showing closure plate 309D, which includes openings 311, but does not include central opening 310.

Figure 18:
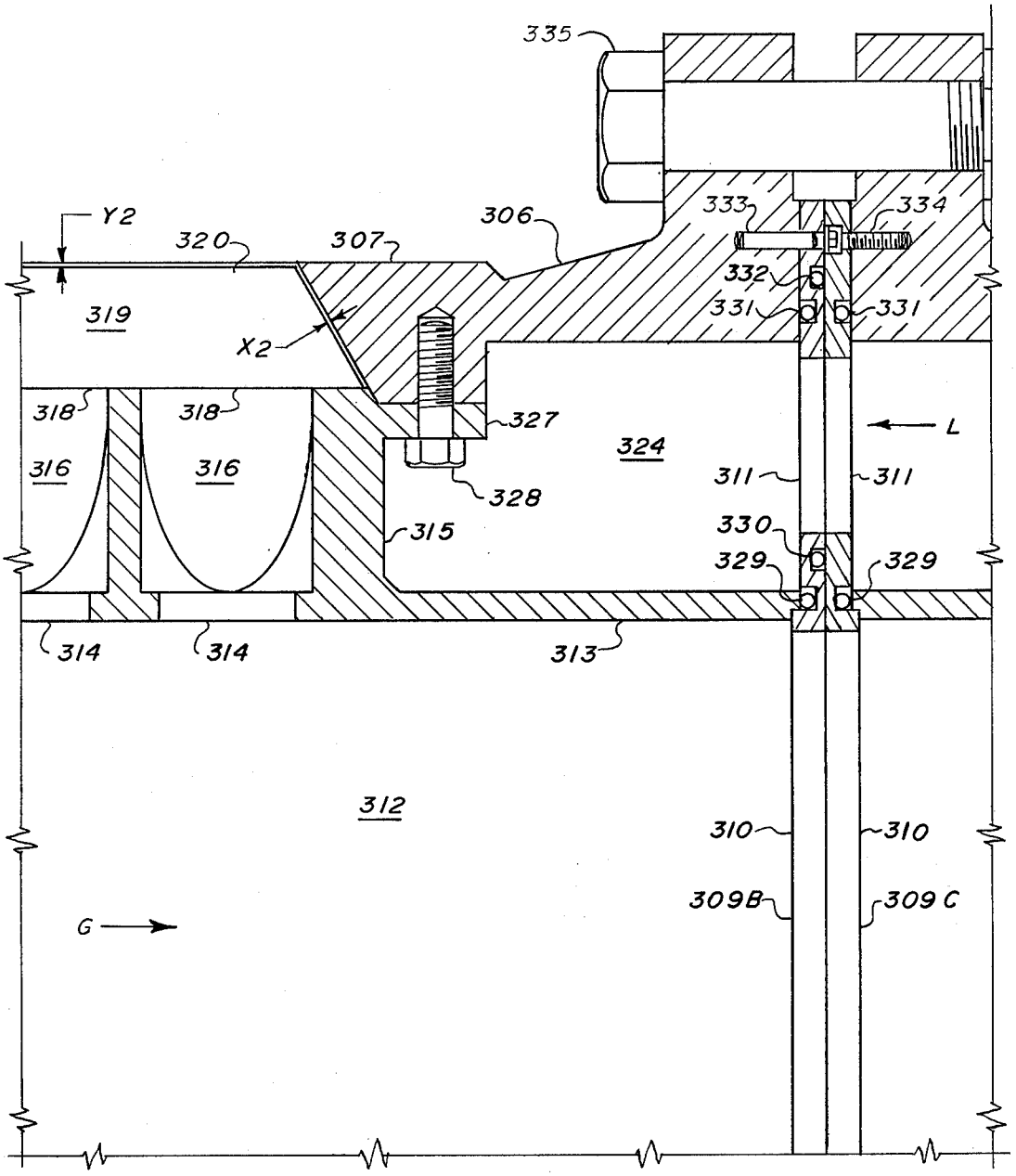
FIG. 18 shows section 18—18 as designated in FIG. 13 and FIG. 16 enlarged eight times.
Figure 19:
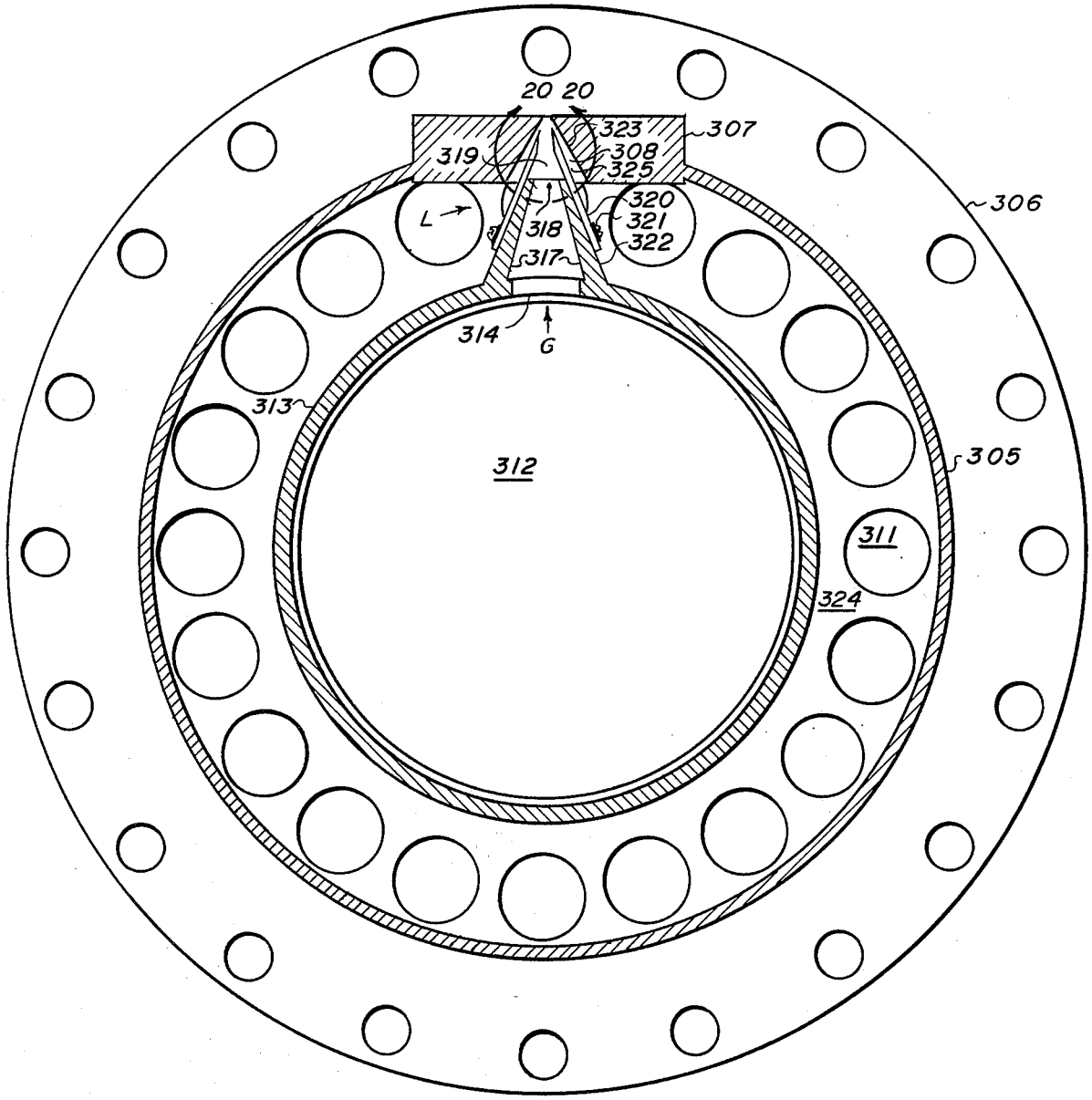
FIG. 19 shows section 19—19 of FIG. 14 enlarged four times.
Figure 20:
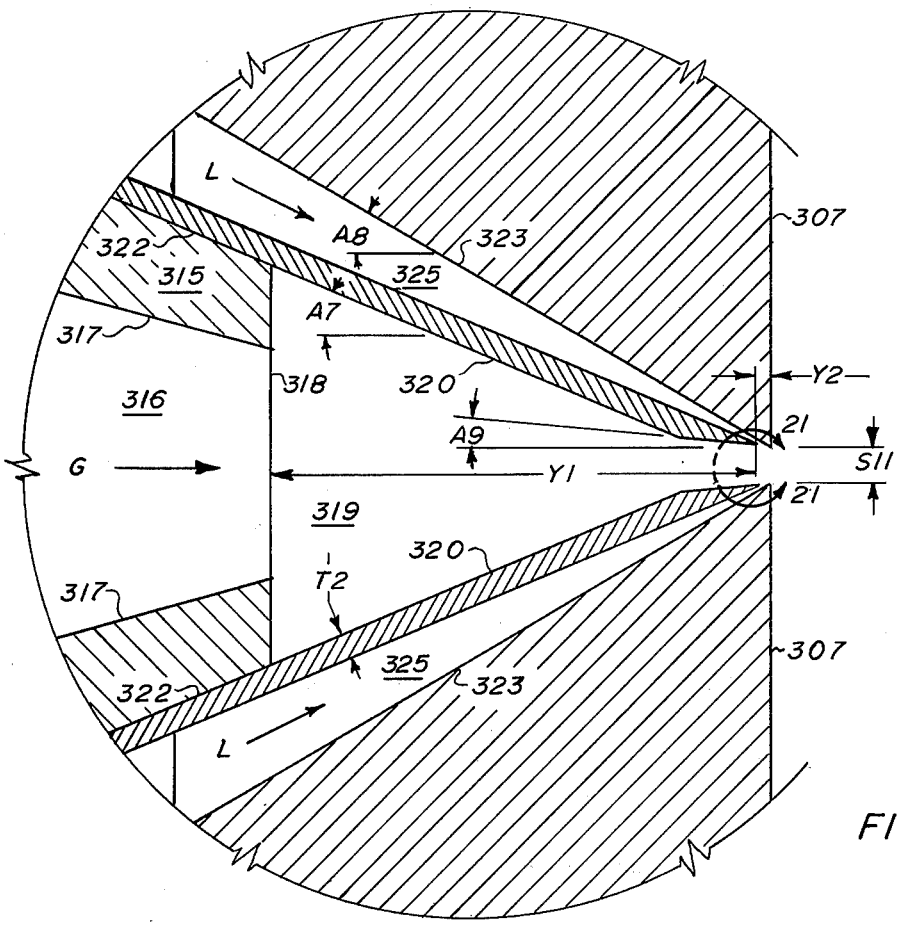
FIG. 20 shows the portion of FIG. 19 designated as 20—20 enlarged eight times.
Figure 21:
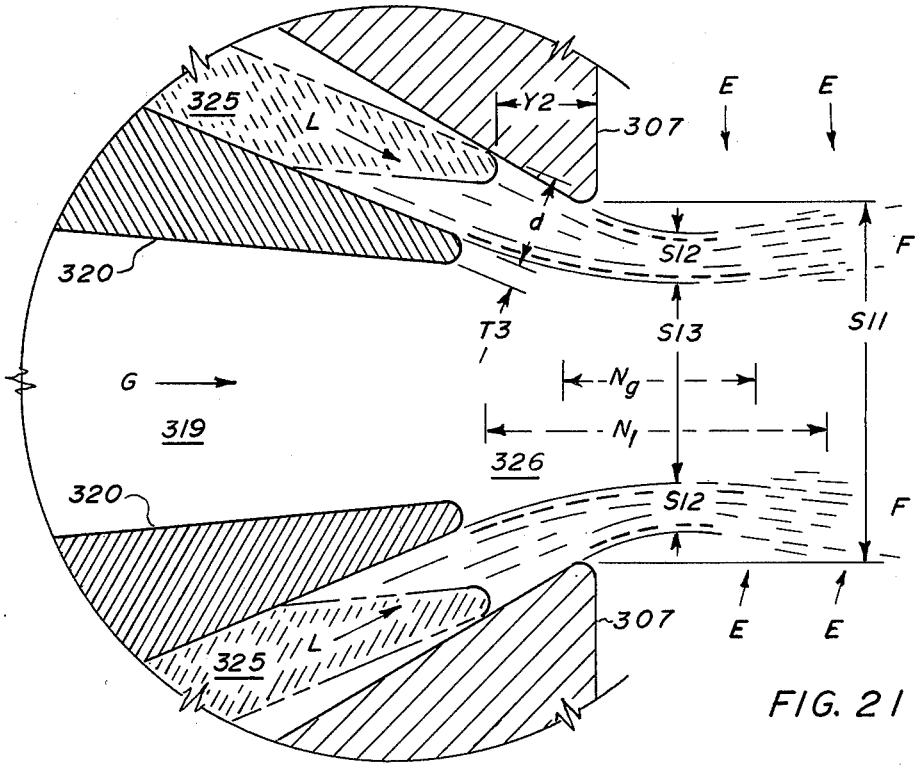
FIG. 21 shows the portion of FIG. 20 designated as 21—21 enlarged ten times.

FIGS. 18 through 21 show the internal construction of nozzle 300. FIG. 18 is a sectional view of the portion of nozzle 300 designated as 18—18 in FIGS. 13 and 16, enlarged eight times. In order to illustrate the assembly with closures 309, the end portion of the adjoining nozzle 300 is included in FIG. 18. FIG. 19 is section 19—19 of FIG. 14, enlarged four times. FIG. 20 shows the portion of FIG. 19 designated as 20—20 rotated 90° and enlarged eight times. FIG. 21 shows the portion of FIG. 20 designated as 21—21, enlarged ten times.

As identified by reference to these four figs. openings 310 lead to central passage 312 running axially through nozzle 300 and enclosed by cylindrical pipe wall 313. Compressed air G exits from central passage 312 radially through circular pipe wall openings 314 into air mainifold 315. For structural rigidity, air mainifold 315, which extends in the X axis direction the full length of face plate 307 and is welded to air pipe wall 313, contains separate compartments 316 corresponding on a one-to-one basis with pipe wall openings 314. Compartments 316 are each in the form of a trucated cylinder with two flat faces 317 and an exit opening 318 for passage of air G into single air channel 319, which converges radially and is formed by two flexible divider wall plates 320. Divider wall plates 320 extend the full length of manifold 315 in the X direction, and are mounted with screws 321 as cantilevers on the external faces, 322, of air manifold 315. Faces 322 are each parallel to the X axis and tapered at an angle A7 relative to the radial air flow direction, herein termed the Y axis of nozzle 300. Face plate opening 308 is trapezoidal in cross section in the Y-Z plane with conically shaped ends. The two plane surfaces 323 of opening 308 each form an angle A8 relative to the Y axis. Four plate 307 is of thickness and width sufficient to preclude significant deformation of slit width S11 under the internal pressures during operation. Each divider wall plate 320 extends in cantilever fashion into opening 308 for a distance Y1, terminating at a relatively small distance Y2 upstream, relative to the external surface of face plate 307, and has a thickness T2, except at its cantilevered end, which is beveled at an angle A9 to an edge thickness T3. Divider wall plates 320 are also beveled at their longitudinal ends to conform approximately to the conical end surfaces of opening 308, and provide a minimum clearance X2.

Openings 311 lead to an annular feed passage 324 formed by outer pipe wall 305 and inner pipe wall 313. Effluent L flows from annular feed passage 324 into two converging wall channels 325, formed within opening 308 by divider wall plates 320 and surfaces 323. Length Y2 forms a converging common channel 326 for liquid and gas sheet flow to exit of opening 308 at slit width S11, where two unsupported liquid sheets of length X1 and approximate thickness S12 are formed adjacent to a centrally located air sheet of approximate thickness S13 in zone $N_g$ the zone of maximum air flow per unit cross-sectional area. Entrainment air E is drawn into expanding plume F at $N_l$, the region of atomization at end of opening 308.

As shown in FIG. 18, the assembly of inner components, consisting of inner pipe 313, manifold 315 and divider wall plates 320, is positioned and secured to face plate 307 by two end tabs 327 and screws 328. Closure plates 309, together with O-rings 329, 330, 331, and 332, serve to seal air and effluent channels 312 and 324 against leakage. They are positioned by pins 333 and secured to flanges 306 by screws 334. O-rings 330 and 332 are omitted with closure plate 309C, and O-rings 330 is omitted with closure plates 309A and 309D. Nozzles 300 and standpipes 302 and 304 are assembled with flange bolts 335.

The method of atomization control as applied to linear nozzle 300, is illustrated by reference to FIGS. 20 and 21, to the typical nozzle dimensions and approximate equations presented in Table V and to the resulting calculations in Table VI.

TABLE V

DIMENSIONS AND EQUATIONS - Nozzle 300

| | |
|---|---|
| Angle A7 = 22½ degrees | Thickness T2 = .09 inches |
| Angle A8 = 30 degrees | Thickness T3 = .01 inches |
| Angle A9 = 5 degrees | Length Y1 = 1.63 inches |
| | Length X1 = 50 inches |
| Width S11 = .12 inches | Length Y2 = .1 in. approx. |

The end deflection, d, of divider wall plates 320 may be expressed in terms of the following cantilever beam equation for a concentrated load at a point y distance from the fixed end of the beam:

$$d = \frac{F_y \cdot y^2}{6\,E_e \cdot I_m}(3Y' - y) \qquad \text{Eq. (16)}$$

from which the water and air supply pressure difference, $P_w - P_a$, required to give a deflection, d, may be estimated by the following summation:

$$d = \frac{(P_w - P_a)(X1)\Delta y}{6\,E_e \cdot I_m}\sum_{i=1}^{i=n}\left(1 - \frac{d^2}{S_y^2}\right)y^2 \cdot (3Y' - y) \qquad \text{Eq. (17)}$$

where: $E_e$ = modulus of elasticity = 30 million psi.
$I_m$ = moment of inertia = (X1)(T2)3/12, in.$^4$
$Y' = Y1/\cos(A7)$; $\Delta y = Y'/n$; $y = i(\Delta y)$
Fy = force, lbs. = $(p_w - p_a)(X1)(\Delta y)$, at point y
$Sy = d + 2(Y' - y)\sin\alpha$, approx., where $2\alpha + \delta = \theta$
$\theta$ = Angle A8 − Angle A7; $\delta = 2\sin^{-1}(d/2Y')$
$P_a$ = air pressure at point y = $P_a$, approx.
$P_w$ = water pressure at point y = $P_w(1 - d^2/S_y^2)$ From Equations 11 and 13, Table II:

$Q_a = 17.5\,(X1)(P_a + P_s) \cdot S_t$, scfm. Eq. (18)
$V_w = 12.2\,(P_w - P_a)^{\frac{1}{2}}$, ft/sec. Eq. (19)
$Q_w = 312\,V_w \cdot S_1 = 312\,V_w \cdot d$, gpm. Eq. (20)

where: $S_t$ = S13 = S11 − 2(S12) = S11 − 2d, approx., in.
$T_g$ = 510 deg. R. = 50 deg. F.
$P_e = P_a$, approx., assumed for estimation.

TABLE VI

TYPICAL OPERATING CONDITIONS - Nozzle 300

| $P_a$ (psig) | | | | | | |
|---|---|---|---|---|---|---|
| | d, inches | .01 | .02 | .03 | .04 | .05 |
| | D, microns (= 25000 d) | 250 | 500 | 750 | 1000 | 1250 |
| | $P_w - P_a$, psi. | 17 | 38 | 62 | 91 | 125 |
| | $V_w$, ft/sec. | 50 | 75 | 96 | 116 | 136 |
| | $Q_w$, gpm. | 160 | 470 | 900 | 1500 | 2100 |
| | $Q_a$, scfm. | 2600 | 2080 | 1560 | 1040 | 520 |
| | $R_f = Q_a/Q_w$ | 16 | 4.5 | 1.7 | .7 | .25 |
| | $P_w$, psig. | 32 | 53 | 77 | 106 | 140 |
| | $Q_a$, scfm. | 5250 | 4200 | 3150 | 2100 | 1050 |
| | $R_f = Q_a/Q_w$ | 32 | 9 | 3.5 | 1.4 | .5 |
| | $P_w$, psig. | 62 | 83 | 107 | 136 | 170 |
| | $Q_a$, scfm. | 7850 | 6300 | 4700 | 3150 | 1570 |
| | $R_f = Q_a/Q_w$ | 49 | 13.5 | 5.2 | 2.1 | .75 |
| | $P_w$, psig. | 92 | 113 | 137 | 166 | 200 |

As the water pressure $P_w$, is increased relative to the air pressure, $P_a$, the cantilever divider wall plates 320 deflect by an amount, d, to increase the thicknesses, S12, of the two unsupported water sheets, and to decrease the minimum thickness, S13 of the air sheet. By varying d, the thickness S12 is intentionally made to be of the same order of magnitude as the desired spray droplet size. Under the assumptions that $P_e = P_a$ and d = S12, as employed in the approximate calculations of Table V, the water flow rate, $Q_w$, and the minimum air sheet thickness, S13, do not vary independently of the liquid sheet thickness, S12. Significant variation in the air-to-water ratio, $R_f$, is achieved, however, by varying $P_a$ and $P_w$.

A theoretical analysis of heat and mass transfer, during the cooling of spray droplets settling in a rising current of air, indicates that the droplet sizes required to cool a power plant effluent 40 deg. F. (22 deg. C.), with a droplet settling distance of 40 to 60 ft. (12 to 18 meters), range from about 400 to 1200 microns, depending upon the ambient air temperature and humidity, and reservoir temperature. Because of the droplet sizes and wide range of operating conditions obtainable, and because of the large amount of atmospheric entrainment produced by gas atomization, linear nozzle 300 provides a practical alternative to cooling towers or other spray methods currently employed with power plant condenser water effluent.

An additional feature of nozzles 100, 200 and 300, as compared to other gas atomizing nozzles in which fixed openings are employed, is that mechanical movement of the converging wall components: 117, 126, 206, 214, 220 and 320 may be employed to permit the passage and elimination of solid foreign particles carried in the liquid or gas streams.

While the method of gas atomization control and variation of this invention has been described in relation to three specific embodiments, variations within the skill of the art are contemplated. The following are cited as examples:

1. Annular nozzles utilizing one liquid and one gas sheet, as in nozzle 100, in which a conical sheet flow is provided such as in nozzle 200.

2. Annular nozzles utilizing one liquid and two gas sheets, as in nozzle 200, in which angle A6 is reduced so as to produce a more axially directed spray plume; in such case the thinning of the liquid sheet within converging common annulus 215 is sacrificed.

3. Nozzles similar to nozzle 200 in which divider wall 214 is extended to a greater radius than that of divider wall 220, so as to provide liquid sheet support during a portion of its conical flow and thickness reduction; such nozzles are particularly applicable to liquids or slurries of intermediate fluidity.

4. Nozzles similar to either nozzle 100 or nozzle 200 in which fixed or limited gas and liquid flow rates and droplet size ranges are permitted, and in which large solid particles are not present; in such nozzles the provisions for relative axial movement of components 117, 126, 206, 214 and 220 may be eliminated in the interest of manufacturing cost reduction, after the required nozzle dimensions have been established.

5. Nozzles similar to nozzle 200 in which the liquid and gas streams, L and G are interchanged.

6. Nozzles similar to nozzle 300 in which a single, flexible divider wall 320 is employed forming one liquid and one gas sheet.

7. Nozzles similar to nozzle 300 in which the liquid and gas streams, L and G are interchanged.

8. Nozzles similar to nozzles 100 to 200 in which the gas and liquid sheets are directed radially relative to a central nozzles axis, i.e., in the case of nozzle 200, angle A6 would be equal to 90 degrees.

9. Nozzles utilizing one gas and one liquid sheet, as in nozzle 100, in which spray plume F is directed radially, and in which divider wall 126 is in the form of a thin, flat and flexible ring mounted as a cantilever perpendicular to the nozzle axis, and in which liquid sheet thickness S1 is determined by ring deflection produced by relative gas and liquid pressures.

These and all such other variations which would be obvious to one skilled in the art are deemed to be within the spirit and scope of the appended claims except where expressly limited otherwise.

I claim:

1. With gas atomizing nozzles, a method of controlling and varying the degree of atomization, the liquid flow rate, and the gas flow rate and resulting spray dilution by entrainment, comprising the following steps:

(a) forming a liquid stream so as to produce an unsupported liquid sheet;

(b) forming an atomizing gas stream so as to produce a gas sheet flowing adjacent to and in substantially the same direction as the unsupported liquid sheet in a region of atomization produced within a region of contact where said gas sheet becomes supported only by said liquid sheet on one broad surface;

(c) conducting said gas and liquid sheets in juxtaposition so that the region of atomization adjoins the zone of maximum mass flow rate of gas per unit cross-sectional area of the gas stream;

(d) adjustably controlling the maximum thickness of the unsupported liquid sheet in the region of atomization and, thereby controlling the droplet size of the spray;

(e) adjustably controlling the thickness of the atomizing gas sheet and, thereby, controlling the quantity of atomizing gas to produce the desired degree of atomization and amount of spray dilution by entrainment for a given liquid flow rate;

(f) controlling gas pressure supplying said gas stream so as to maintain a predetermined velocity of gas flow in said region of atomization;

(g) controlling the maximum liquid pressure supplying said liquid stream so that the unsupported liquid sheet flows at a velocity that is less than 15% said predetermined velocity in the region of atomization;

(h) directing the flow of a secondary gas stream so that it is entrained into the spray at the region of atomization to effect a smooth and immediate dilution of the spray with a minimum recirculation of droplets; and, (i) determining the liquid capacity and gas consumption at a constant degree of atomization by proportion to the transverse dimension of the unsupported liquid sheet.

2. With gas atomizing nozzles, a method according to claim 1 further comprising:

(a) forming a second high velocity gas stream flowing as a sheet of similar thickness and velocity as that of the first gas sheet adjacent to the opposite surface of the unsupported liquid sheet; and, (b) directing its flow in substantially the same general direction as the unsupported liquid sheet while interacting with and aiding in the atomization of the liquid sheet.

3. With gas atomizing nozzles, a method according to claim 1 wherein said predetermined velocity is substantially sonic.

4. With gas atomizing nozzles, a method according to claim 1, further comprising:

(a) forming a second liquid stream flowing as an unsupported sheet of similar thickness and velocity as that of the first liquid sheet adjacent to and on the opposite side of the gas sheet; and, (b) directing its flow in substantially the same direction as the gas sheet in the region of atomization.

5. With gas atomizing nozzles, a method according to claim 1, wherein said gas sheet and said liquid sheet are substantially annular and further comprising introducing a secondary gas stream moving in the same direction as said sheets into a central passage through the central axis of said sheets so that it mixes with said sheets at the region of atomization to effect a smooth and immediate dilution of the spray with minimum recirculation of atomized droplets.

6. With gas atomizing nozzles, a method according to claim 1, further comprising, directing said flowing liquid sheet so as to cause a radially increasing flow direction component to produce a thinning of the liquid sheet downstream of its point of formation as the result of mass conservation in flow.

7. A gas atomizing nozzle comprising:

(a) at least one converging wall liquid feed channel shaped so as to form the liquid stream flowing therefrom to become an unsupported sheet of an initial thickness in a region of atomization commensurate with desired spray droplet size, in the range of 0.01 to 0.10 centimeters;

(b) at least one converging wall, atomizing gas feed channel located adjacent to a liquid sheet forming channel, separated from the adjacent liquid feed channel by a divider wall and shaped to form the gas stream flowing therefrom to become a sheet of a thickness sufficient to produce the desired degree of atomization and spray dilution by gas entrainment;

(c) a converging wall common channel joining at its upstream end the downstream ends of said liquid feed channel and said gas feed channel so the liquid and gas in said liquid feed channel and said gas feed channel merge smoothly into adjoining flow in sheet form in said common channel, said common channel shaped so that the zone of maximum mass flow of gas per unit cross-sectional area adjoins the region of atomization;

(d) said liquid feed channel and said gas feed channel having means to adjust the spacing between the channel walls to vary the thickness of flowing liquid and gas sheets in the region of atomization; and, (e) said common channel having walls with broad dimensions transverse to the direction of flow in the range of 50 to 1000 times the spacing between them at its termination.

8. A gas atomizing nozzle according to claim 7 in which the liquid feed channel, the gas feed channel, and the common channel are annular and concentric to a central nozzle axis and further comprising a central passage through the nozzle along said nozzle axis shaped to allow a secondary gas stream to flow along the nozzle axis to be entrained by and mixed with spray passing from said common channel at the region of atomization.

9. A gas atomizing nozzle according to claim 8 having an annular channel radius at the point of formation of the unsupported liquid sheet ranging from 2 to 20 centimeters.

10. A gas atomizing nozzle according to claim 8 in which the liquid feed channel, gas feed channel and common channel are shaped and oriented so as to produce conically flowing directions thereby causing a thinning of liquid sheet produced during flow within the common channel.

11. A gas atomizing nozzle according to claim 7 in which said liquid feed channel, said gas feed channel and said common channel are linearly elongated transversely to the direction of flow and in which adjacent liquid and gas feed channels are separated by a divider wall in the form of a thin flexible plate, said divider wall mounted as a cantilever and orientated so that the relative thicknesses of the gas and liquid sheets formed within the adjacent channels can be varied by deflection of the divider wall.

12. A gas atomizing nozzle according to claim 7 containing one liquid feed channel and one gas feed channel in which the walls of the liquid feed channel, the gas feed channel and the common flow channel are concentric to a central nozzle axis and oriented so as to produce a spray pattern directed radially with respect to the central nozzle axis, said liquid feed channel and said gas feed channel being separated by a divider wall in the form of a thin, flexible flat-plate ring mounted as a cantilever and positioned in a plane perpendicular to the nozzle axis whereby relative thicknesses of gas and liquid sheets formed in the channels can be varied by deflection of the divider wall.

13. A gas atomizing nozzle according to claim 7 in which said common channel terminates at said zone of maximum mass flow of gas per unit cross-sectional area.

* * * * *